US007775194B2

(12) United States Patent
Kono et al.

(10) Patent No.: US 7,775,194 B2
(45) Date of Patent: Aug. 17, 2010

(54) AUTOMATIC RESIDUAL FUEL VENT DEVICE FOR CARBURETOR

(75) Inventors: Masakatsu Kono, Wako (JP); Keiji Iino, Wako (JP); Yoshitaka Oota, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 7 days.

(21) Appl. No.: 12/375,865

(22) PCT Filed: Jul. 31, 2007

(86) PCT No.: PCT/JP2007/064955

§ 371 (c)(1),
(2), (4) Date: Jan. 30, 2009

(87) PCT Pub. No.: WO2008/016037

PCT Pub. Date: Feb. 7, 2008

(65) Prior Publication Data

US 2009/0308357 A1 Dec. 17, 2009

(30) Foreign Application Priority Data

Aug. 1, 2006 (JP) ..... 2006-209824

(51) Int. Cl.
*F02M 5/10* (2006.01)
*F02D 17/04* (2006.01)

(52) U.S. Cl. ..... 123/517; 123/198 DB

(58) Field of Classification Search ..... 123/516, 123/517, 518, 519, 198 DB
See application file for complete search history.

(56) References Cited

U.S. PATENT DOCUMENTS 2,965,086 A * 12/1960 Gregory et al. ..... 123/517

(Continued)

FOREIGN PATENT DOCUMENTS

JP 46-32970 Y1 11/1971

(Continued)

*Primary Examiner*—Thomas N Moulis
(74) *Attorney, Agent, or Firm*—Arent Fox LLP

(57) ABSTRACT

An automatic residual fuel vent device for a carburetor, the device including a fuel supply passage (15) connecting a fuel tank (TF) and a float chamber (10), a negative pressure passage (17) connecting an intake passage (8) and a negative pressure operating chamber (53) of a diaphragm pump (PD), a fuel vent passage (16) connecting the float chamber (10) and the fuel tank (TF), a single changeover cock (CO) provided so as to straddle the fuel supply passage (15) and the negative pressure passage (17), a negative pressure surge tank (TS) provided in the negative pressure passage (17), and the diaphragm pump (PD), which is connected to the fuel vent passage (16) and is operated by negative pressure of the negative pressure surge tank (TS), residual fuel of the float chamber (10) being returned to the fuel tank (TF) by the diaphragm pump (PD) operated by negative pressure from the negative pressure surge tank (TS) in accordance with the changing over of the changeover cock (CO). This enables residual fuel within the float chamber of the carburetor to be reliably returned to the fuel tank by intake negative pressure accumulated in the negative pressure surge tank and, furthermore, residual fuel can be vented by the changing over of a single changeover cock, thus enabling the number of components to be reduced and the device to be provided at a low cost.

4 Claims, 24 Drawing Sheets

U.S. PATENT DOCUMENTS

| | | | | |
|---|---|---|---|---|
| 2,986,133 | A * | 5/1961 | Mattson | 123/517 |
| 3,048,157 | A * | 8/1962 | Gregory et al. | 123/517 |
| 3,277,877 | A * | 10/1966 | Rosenberg | 123/517 |
| 3,534,721 | A * | 10/1970 | King | 123/517 |
| 3,601,107 | A * | 8/1971 | Rohrbacher et al. | 123/517 |
| 3,618,909 | A * | 11/1971 | Toda et al. | 261/72.1 |
| 3,640,257 | A * | 2/1972 | Cornelius | 123/518 |
| 4,811,718 | A * | 3/1989 | Sonoda | 123/517 |
| 6,202,631 | B1 * | 3/2001 | Yamamoto et al. | 123/516 |
| 6,691,683 | B2 * | 2/2004 | Gracyalny et al. | 123/516 |
| 7,263,981 | B2 * | 9/2007 | Woody | 123/517 |
| 7,424,884 | B2 * | 9/2008 | Woody | 123/517 |
| 7,556,025 | B2 * | 7/2009 | Sotiriades | 123/516 |
| 7,568,472 | B2 * | 8/2009 | Woody | 123/517 |
| 2008/0178850 | A1 * | 7/2008 | Bejcek et al. | 123/517 |

FOREIGN PATENT DOCUMENTS

| | | | |
|---|---|---|---|
| JP | 54-113826 | | 8/1979 |
| JP | 54-127435 | | 9/1979 |
| JP | 56-31653 | | 3/1981 |
| JP | 56-45156 | | 4/1981 |
| JP | 57-193109 | U | 12/1982 |
| JP | 59-97257 | U | 7/1984 |
| JP | 60-27808 | Y2 | 8/1985 |
| JP | 62-29722 | A | 2/1987 |
| JP | 1-59427 | B2 | 12/1989 |
| JP | 2-76225 | | 7/1990 |
| JP | 2-125709 | | 11/1990 |
| JP | 4-34459 | U | 3/1992 |
| JP | 4-82355 | U | 7/1992 |
| JP | 7-317619 | A | 12/1995 |

* cited by examiner

ENGINE RUNNING STATE

ENGINE RUNNING STATE

ENGINE RUNNING STATE

ENGINE RUNNING STATE

ENGINE RUNNING STATE

AUTOMATIC RESIDUAL FUEL VENT DEVICE FOR CARBURETOR

CROSS-REFERENCE TO RELATED APPLICATION

This application is a National Stage entry of International Application No. PCT/JP2007/064955, filed Jul. 31, 2007, which claims priority to Japanese Application No. 2006-209824, filed Aug. 1, 2006, the disclosure of the prior applications are hereby incorporated in their entirety by reference.

TECHNICAL FIELD

The present invention relates to an automatic residual fuel vent device for a carburetor in an engine equipped with a float type carburetor, in which, when the engine is stopped, fuel remaining in a float chamber is returned to a fuel tank by utilizing negative pressure from a negative pressure generating part of the engine.

BACKGROUND ART

Conventionally, in an engine equipped with a float type carburetor, such as a general purpose small engine, if the engine is left for a long period of time in an unused state with fuel remaining in a float chamber of the carburetor, the residual fuel gradually oxidizes and forms a gum within the float chamber, the fuel clogs a main jet or a breather hole, thus causing engine starting faults or poor running, and there is also the problem that when the engine is tilted the residual fuel flows into an intake passage through a nozzle.

In order to solve such problems, conventionally a drain plug is provided in a lower part of the carburetor, and after the engine is used or before it is stored the drain plug is manually operated so as to drain the residual fuel, but such an operation is not only troublesome and difficult but also undesirable in terms of the environment because of contamination of the surroundings of the engine, which is a problem.

Automatic residual fuel vent means have already been disclosed in, for example, Patent Publications 1 and 2 below, in which fuel within a float chamber of a carburetor is automatically vented by utilizing intake negative pressure of an engine before the engine is stopped, and is returned to a fuel tank.

Patent Publication 1: Japanese Utility Model Registration Publication No. 60-27808

Patent Publication 2: Japanese Patent Publication No. 1-59427

DISCLOSURE OF INVENTION

Problems to be Solved by the Invention

However, in the arrangements disclosed in Patent Publications 1 and 2, since residual fuel within the float chamber is returned to the fuel tank by utilizing intake negative pressure, there is the problem that it is difficult to draw out all the residual fuel within the float chamber, particularly after the engine is completely stopped; furthermore, a plurality of cocks for drawing out residual fuel and a coupling mechanism for operating the cocks are necessary, and there are also the problems that the number of components increases, the structure becomes complicated, and the cost rises.

The present invention has been accomplished in the light of such circumstances, and it is an object thereof to provide a novel automatic residual fuel vent device for a carburetor that can solve the above problems.

Means for Solving the Problems

In order to attain the above object, according to a first aspect of the present invention, there is provided an automatic residual fuel vent device for a carburetor in an engine equipped with a float type carburetor to which fuel within a breather-equipped fuel tank is supplied via a changeover cock, the automatic residual fuel vent device comprising:

a fuel supply passage connecting a bottom part of the fuel tank and a float chamber of a carburetor; a negative pressure passage connecting a negative pressure generating part of an engine and a negative pressure operating chamber of a diaphragm pump; a fuel vent passage connecting a bottom part of the float chamber of the carburetor and an upper part of the fuel tank; a single changeover cock provided so as to straddle the fuel supply passage and the negative pressure passage and selectively changing over between providing or blocking communication of the fuel supply passage, providing or blocking communication of the negative pressure passage, and providing or blocking communication of the negative pressure passage with the atmosphere; a negative pressure surge tank provided in the negative pressure passage between the negative pressure generating part of the engine and the changeover cock; and the diaphragm pump, which is connected partway along the fuel vent passage and is operated by negative pressure of the negative pressure surge tank;

fuel within the fuel tank being supplied to the float chamber based on control of changeover of the single changeover cock, and residual fuel of the float chamber being drawn up by the diaphragm pump operated by negative pressure accumulated within the negative pressure surge tank and being returned to the fuel tank.

Additionally, in order to attain the above object, according to a second aspect of the present invention, there is provided an automatic residual fuel vent device for a carburetor in an engine equipped with a float type carburetor to which fuel within a breather-equipped fuel tank is supplied via a changeover cock, the automatic residual fuel vent device comprising:

a fuel supply passage connecting a bottom part of the fuel tank and a float chamber of a carburetor; a negative pressure passage connecting a negative pressure generating part of an engine and a negative pressure operating chamber of a diaphragm pump; a fuel vent passage connecting a bottom part of the float chamber of the carburetor and an upper part of the fuel tank; a single changeover cock provided so as to straddle the fuel supply passage and the negative pressure passage and selectively changing over between providing or blocking communication of the fuel supply passage and providing or blocking communication of the negative pressure passage; a negative pressure surge tank provided in the negative pressure passage between the negative pressure generating part of the engine and the changeover cock; and the diaphragm pump, which is connected partway along the fuel vent passage, is operated by negative pressure of the negative pressure surge tank, and has an atmosphere communication passage provided in the negative pressure operating chamber;

fuel within the fuel tank being supplied to the float chamber based on control of changeover of the single changeover cock, and residual fuel of the float chamber being drawn up by the diaphragm pump and returned to the fuel tank.

Further, in order to attain the above object, according to a third aspect of the present invention, there is provided an automatic residual fuel vent device for a carburetor in an engine equipped with a float type carburetor to which fuel within a hermetically sealed fuel tank is supplied via a changeover cock, the automatic residual fuel vent device comprising:

a fuel supply passage connecting a bottom part of the fuel tank and a float chamber of a carburetor; a negative pressure passage connecting a negative pressure generating part of an engine and a hermetically sealed air chamber of an upper part of the fuel tank; a fuel vent passage connecting a bottom part of the float chamber of the carburetor and the hermetically sealed air chamber of the upper part of the fuel tank; a single changeover cock provided so as to straddle the fuel supply passage and the negative pressure passage and selectively changing over between providing or blocking communication of the fuel supply passage, providing or blocking communication of the negative pressure passage, and providing or blocking communication of the negative pressure passage with the atmosphere; and a negative pressure surge tank provided in the negative pressure passage between the negative pressure generating part of the engine and the changeover cock;

fuel within the fuel tank being supplied to the float chamber based on control of changeover of the single changeover cock, and residual fuel of the float chamber being drawn up by negative pressure accumulated within the negative pressure surge tank and being returned to the fuel tank.

Furthermore, in order to attain the above object, according to a fourth aspect, in addition to the first, second or third aspect, the negative pressure generating part is an intake passage of an intake system of the engine or a crank chamber of the engine.

EFFECTS OF THE INVENTION

In accordance with the aspects of the present invention, residual fuel within the float chamber can reliably be returned to the fuel tank by negative pressure accumulated in the negative pressure surge tank, in particular even after the engine is stopped; furthermore, residual fuel can be vented by a single changeover cock, the number of components can be reduced thus enabling the device to be provided at a low cost, and there are fewer malfunctions and high reliability.

EXPLANATION OF REFERENCE NUMERALS AND SYMBOLS

Figure 1:
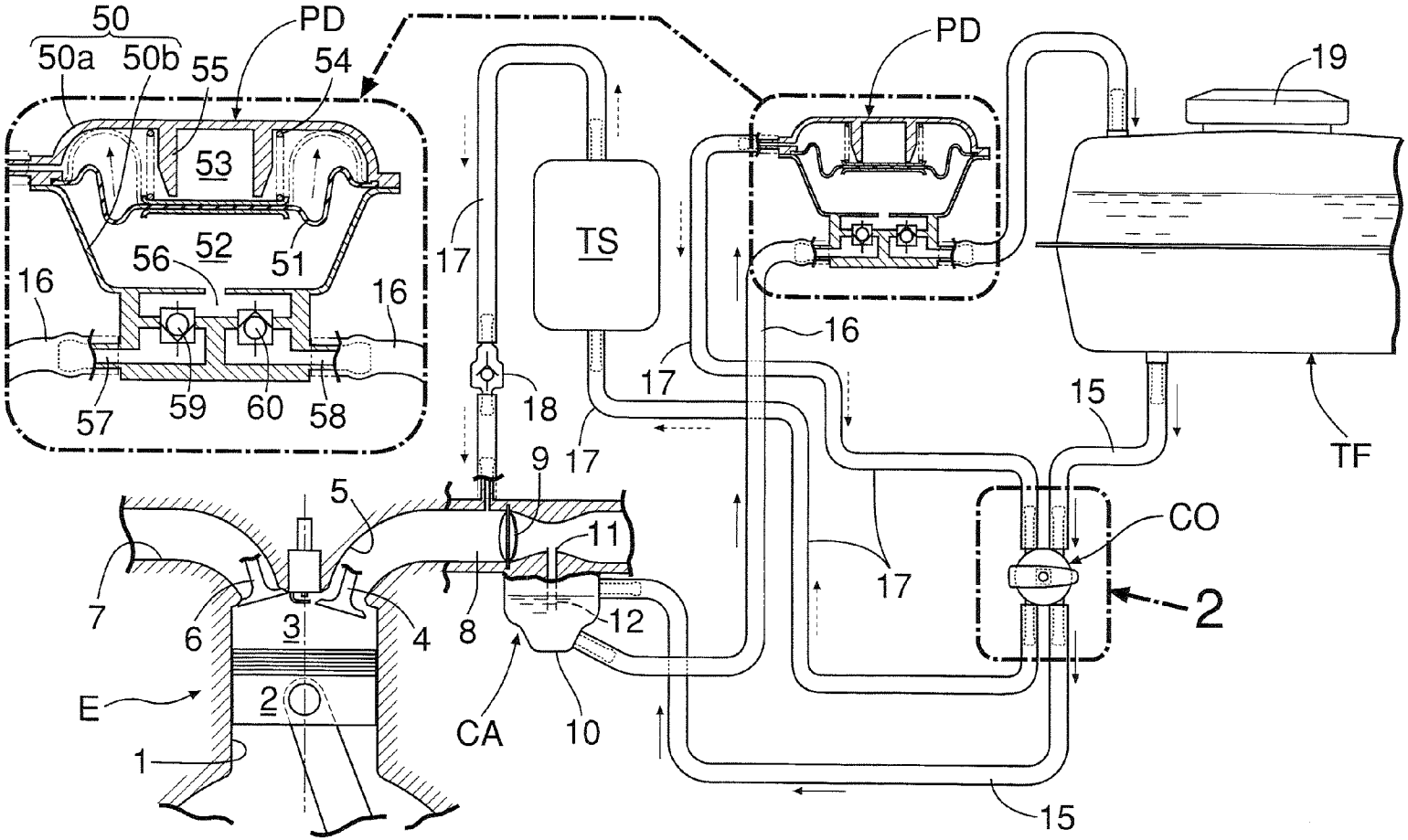
FIG. 1 is an overall schematic diagram of an automatic residual fuel vent device for a carburetor related to a first embodiment.

8 Intake passage
10 Float chamber
13 Crank chamber
15 Fuel supply passage
16 Fuel vent passage
17 Negative pressure passage
53 Negative pressure operating chamber (diaphragm pump)
E Engine
CA Carburetor
CO Changeover cock
PD Diaphragm pump
TF Fuel tank
TS Negative pressure surge tank

BEST MODE FOR CARRYING OUT THE INVENTION

Modes for carrying out the present invention are specifically explained below by reference to embodiments of the present invention exemplified in the attached drawings. These embodiments refer to a case in which the automatic residual fuel vent device for a carburetor of the present invention is applied to a small general purpose engine.

A first embodiment of the present invention is now explained by reference to FIGS. 1 to 8.

In FIG. 1, a general purpose engine E is an OHV type four cycle engine, in which a combustion chamber 3, at the top of a piston 2, of a cylinder 1 communicates with an intake port 5, which is opened and closed by an intake valve 4, and an exhaust port 7, which is opened and closed by an exhaust valve 6. Connected to an intake passage 8 communicating with the intake port 5 is a conventionally known float type carburetor CA, which controls the supply of a fuel-air gas mixture to the intake passage 8, and provided in the intake passage 8 on the downstream side of the carburetor CA is a throttle valve 9. The float type carburetor CA is equipped as usual with a float chamber 10 storing a fixed amount of fuel, the interior of the float chamber 10 communicates with a venturi part of the intake passage 8 via a main nozzle 11, and a main jet 12 immersed in fuel is provided at the lower end of the main nozzle 11.

A lower part of a fuel tank TF disposed at a position higher than the engine E and the float chamber 10 of the carburetor CA are connected to each other via a fuel supply passage 15, and a changeover cock CO, which is described later, opening and closing the fuel supply passage 15 is provided partway along the fuel supply passage 15, and in accordance with changeover control of the changeover cock CO, fuel within the fuel tank TF is supplied to the interior of the float chamber 10 by falling under gravity. A normal breather (not illustrated) is provided in a fuel cap 19 of the fuel tank TF, and a breathing action takes place between the interior of the fuel tank TF and the exterior through the breather.

Furthermore, an upper part of the fuel tank TF and a lower part of the float chamber 10 are connected to each other via a fuel vent passage 16, and a diaphragm pump PD, which will be described later, is provided partway along the fuel vent passage 16.

Moreover, the downstream side of the intake passage 8 relative to the throttle valve 9 and a negative pressure operating chamber 53 of the diaphragm pump PD are connected to each other via a negative pressure passage 17, a hermetically sealed negative pressure surge tank TS storing negative pressure is connected partway along the negative pressure passage 17, a one-way valve 18 preventing backflow of negative pressure is provided partway along the negative pressure passage 17 between the negative pressure surge tank TS and the intake passage 8, and the changeover cock CO is provided in the negative pressure passage 17 between the negative pressure surge tank TS and the diaphragm pump PD.

The structure of the changeover cock CO is now explained in detail by reference to FIGS. 2 to 7.

A cock case 20 of the changeover cock CO is formed in a flattened cylindrical shape with an open top face; this cock case 20 is provided with four, that is, first to fourth ports 21 to 24, these ports 21 to 24 have connected respectively thereto first to fourth inflow/outflow pipes 25 to 28 extending outside the cock case 20, the first and third inflow/outflow pipes 25 and 27 extend outward in parallel to each other on one side of the cock case 20, and the second and fourth inflow/outflow pipes 26 and 28 extend outward in parallel to each other on the other side of the cock case 20. Moreover, an atmosphere communication opening 30 opens in the cock case 20 between the second and fourth inflow/outflow pipes 26 and 28, and a filter 31 is provided at the exit of this atmosphere communication opening 30. A disk-shaped support plate 32 is fitted into and fixed to the interior of the cock case 20, and communication openings 33 to 36 communicating with the first to fourth ports 21 to 24 and a communication opening 37 communicating with the communication opening 30 are bored in the support plate 32. A plate-shaped cock body 38 is fitted into the open face side of the cock case 20 so as to slide-rotate on the support plate 32 via a packing 39, and this cock body 38 is rotatably retained within the cock case 20 by a ring-shaped retaining member 40 secured to the open face of the cock case 20 by screwing 41. A male portion 38*a* projectingly provided integrally with a central part of an upper face of the cock body 38 is non-rotatably fitted into a female portion of a handle 42, and the handle 42 and the cock body 38 are fixed by a screw 43. An arc-shaped communication groove 45 with the center of rotation of the cock body 38 as its center is provided in the cock body 38, and rotating the cock body 38 with the handle 42 allows the communication groove 45, as described later, to provide or block communication between the first port 21 and the second port 22 or provide or block communication between the third port 23 and the fourth port 24, and also provide or block communication between the atmosphere communication opening 30 and the third port 23 and fourth port 24.

The first port 21 is connected via the first inflow/outflow pipe 25 to the fuel supply passage 15 communicating with the lower part of the fuel tank TF, and the second port 22 communicates via the second inflow/outflow pipe 26 with the fuel supply passage 15 communicating with the float chamber 10. Furthermore, the third port 23 communicates via the third inflow/outflow pipe 39 with the negative pressure passage 17 connected to the negative pressure operating chamber 53 of the diaphragm pump PD, which is described later, and the fourth port 24 communicates via the fourth inflow/outflow pipe 28 with the negative pressure passage 17 connected to the negative pressure surge tank TS.

The structure of the diaphragm pump PD is now explained by reference to FIG. 1; a pump case 50 of this pump PD is formed in a hermetically sealed state by integrally abutting and joining two pump case halves 50*a* and 50*b*, a flexible diaphragm 51 is air-tightly provided so as to stretch over the interior of the pump case 50, and this diaphragm 51 divides the interior of the pump case 50 into a lower pump chamber 52 and the upper negative pressure operating chamber 53. A diaphragm spring 54 urging the diaphragm 51 toward the pump chamber 52 side is provided within the negative pressure operating chamber 53 and, moreover, a stopper 55 for retaining the diaphragm 51 at a predetermined position is also provided. A fuel passage 56 communicating with the pump chamber 52 is provided in the lower part of the pump case 50, and an inlet port 57 and an outlet port 58 open so as to face each other on opposite left and right sides of the fuel passage 56. Connected to the inlet port 57 is the upstream side of the fuel vent passage 16, which communicates with the lower part of the float chamber 10, and connected to the outlet port 58 is the downstream side of the fuel supply passage 16, which communicates with the upper part of the fuel tank TF. A pair of one-way valves 59 and 60 are provided within the fuel passage 56, and these one-way valves 59 and 60 are arranged so that backflow of fuel from the fuel tank TF to the float chamber 10 is prevented.

The operation of this first embodiment is now explained.

Figure 2:
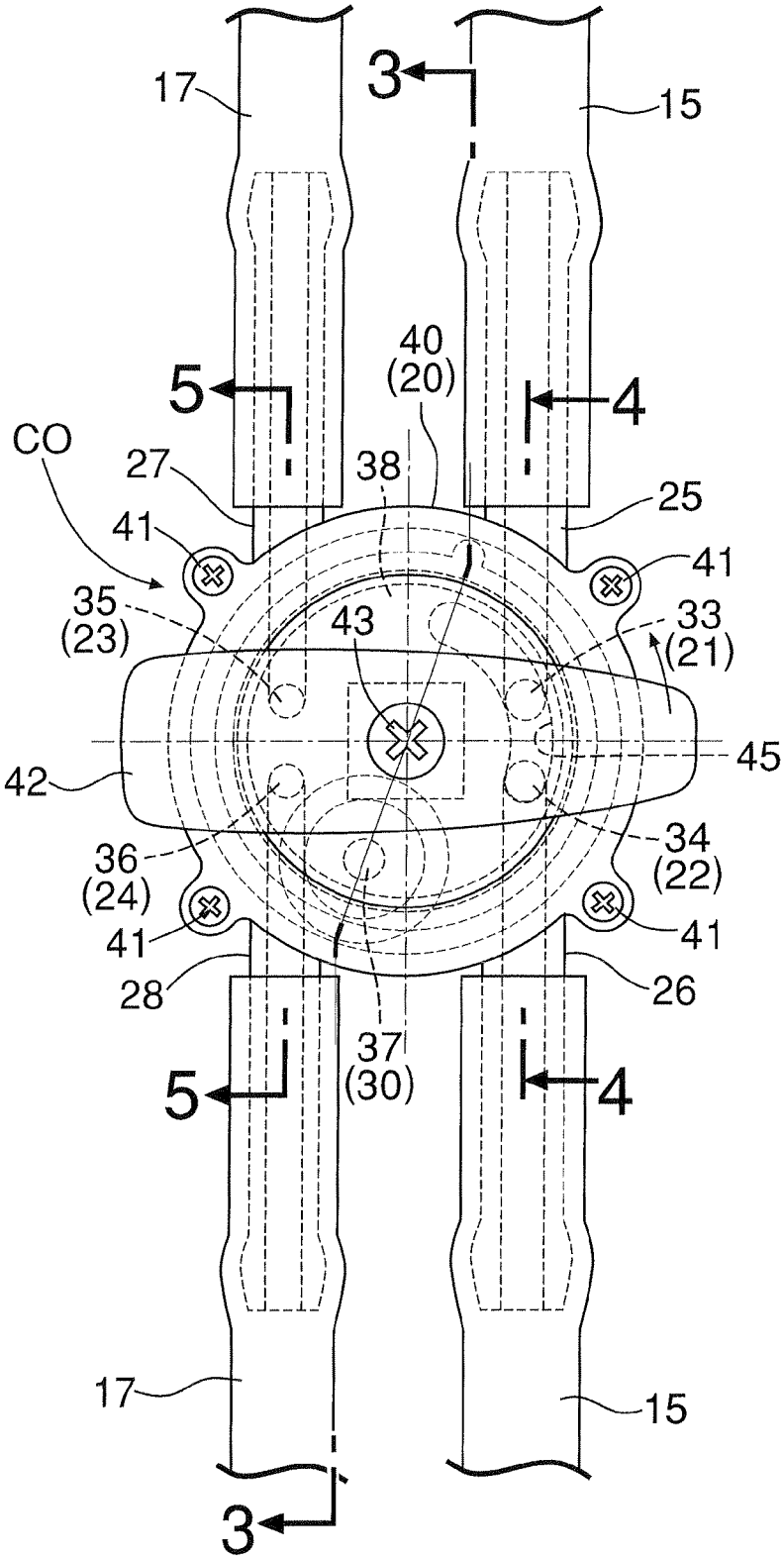
FIG. 2 is an enlarged view of a portion surrounded by a phantom line shown by arrow 2 in FIG. 1.
Figure 3:
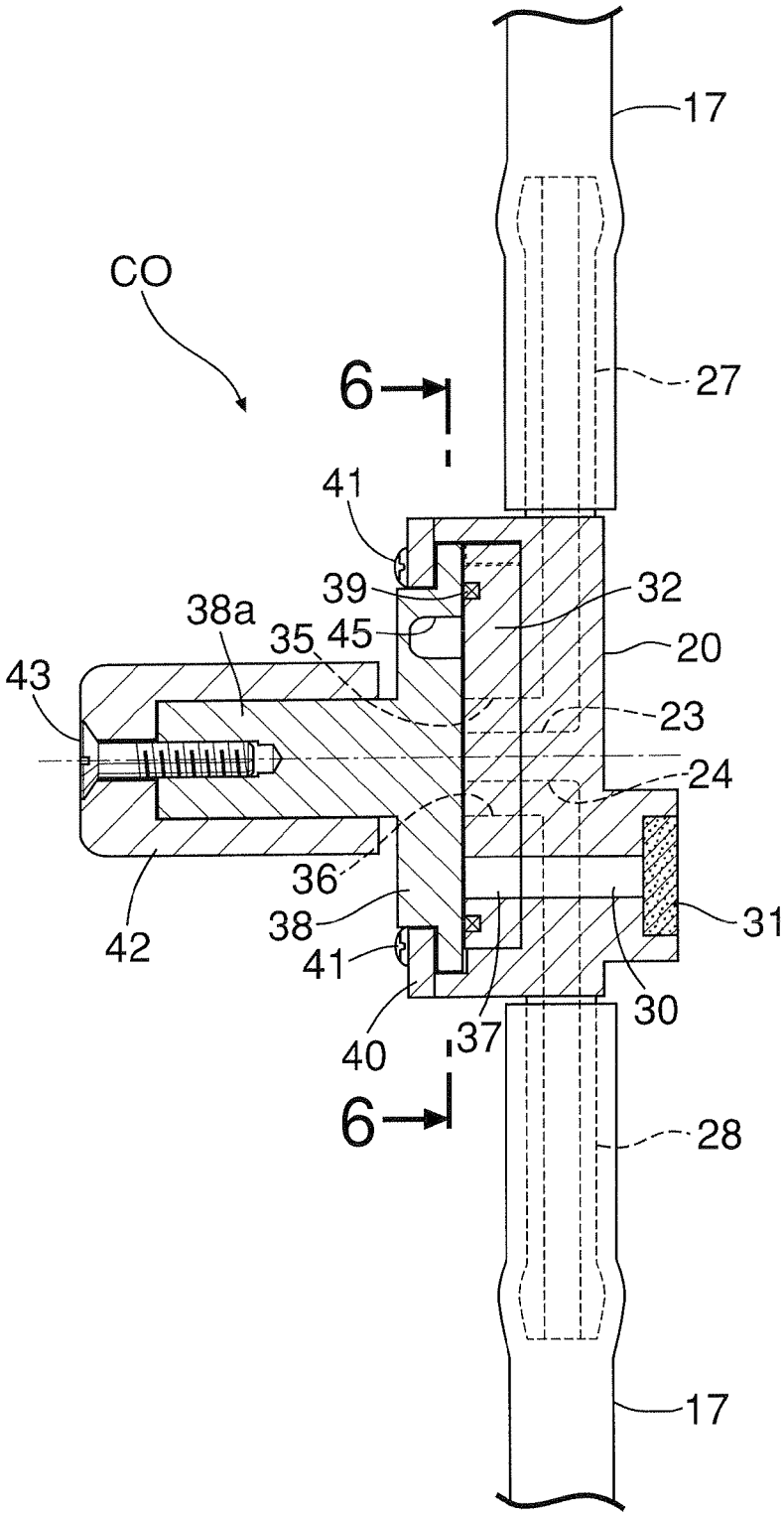
FIG. 3 is a sectional view along line 3-3 in FIG. 2.
Figure 4:
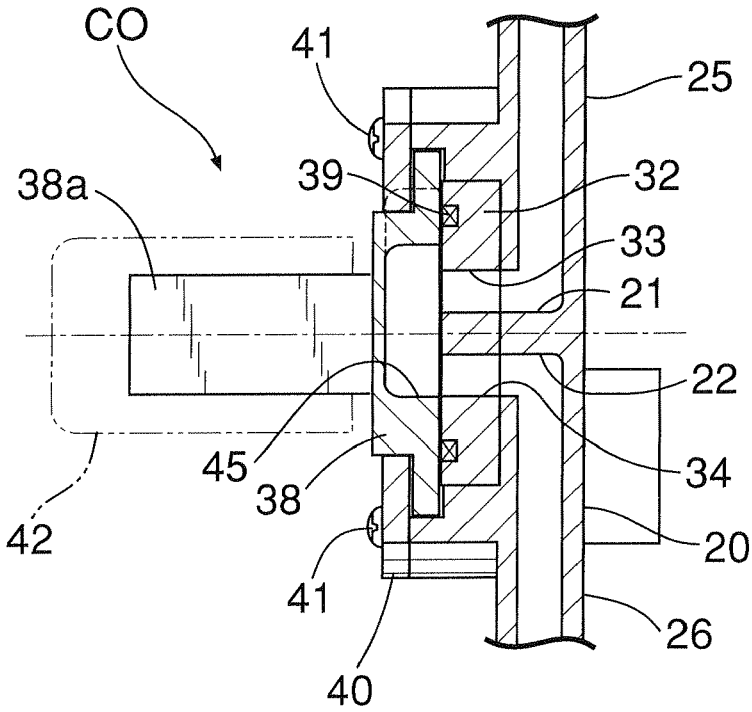
FIG. 4 is a sectional view along line 4-4 in FIG. 2.
Figure 5:
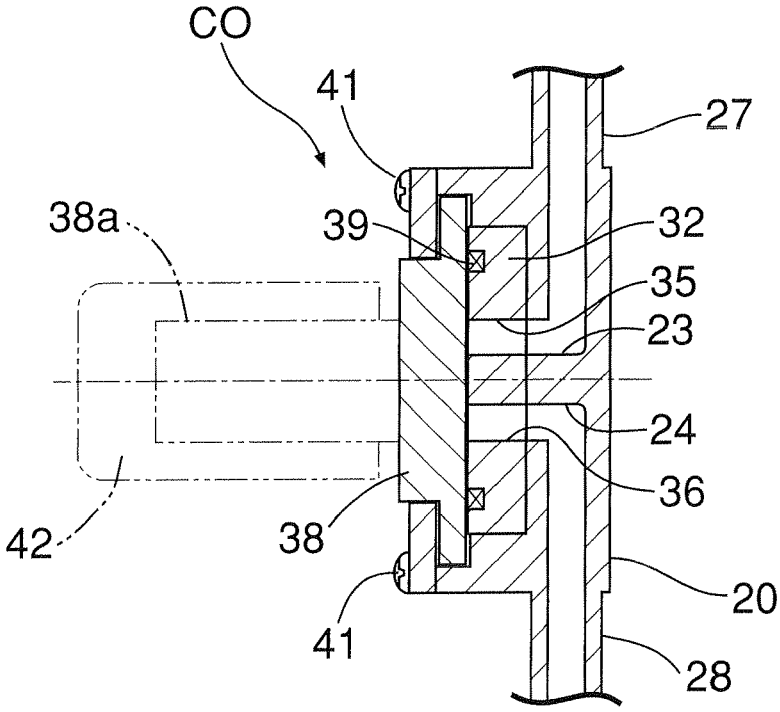
FIG. 5 is a sectional view along line 5-5 in FIG. 2.
Figure 6:
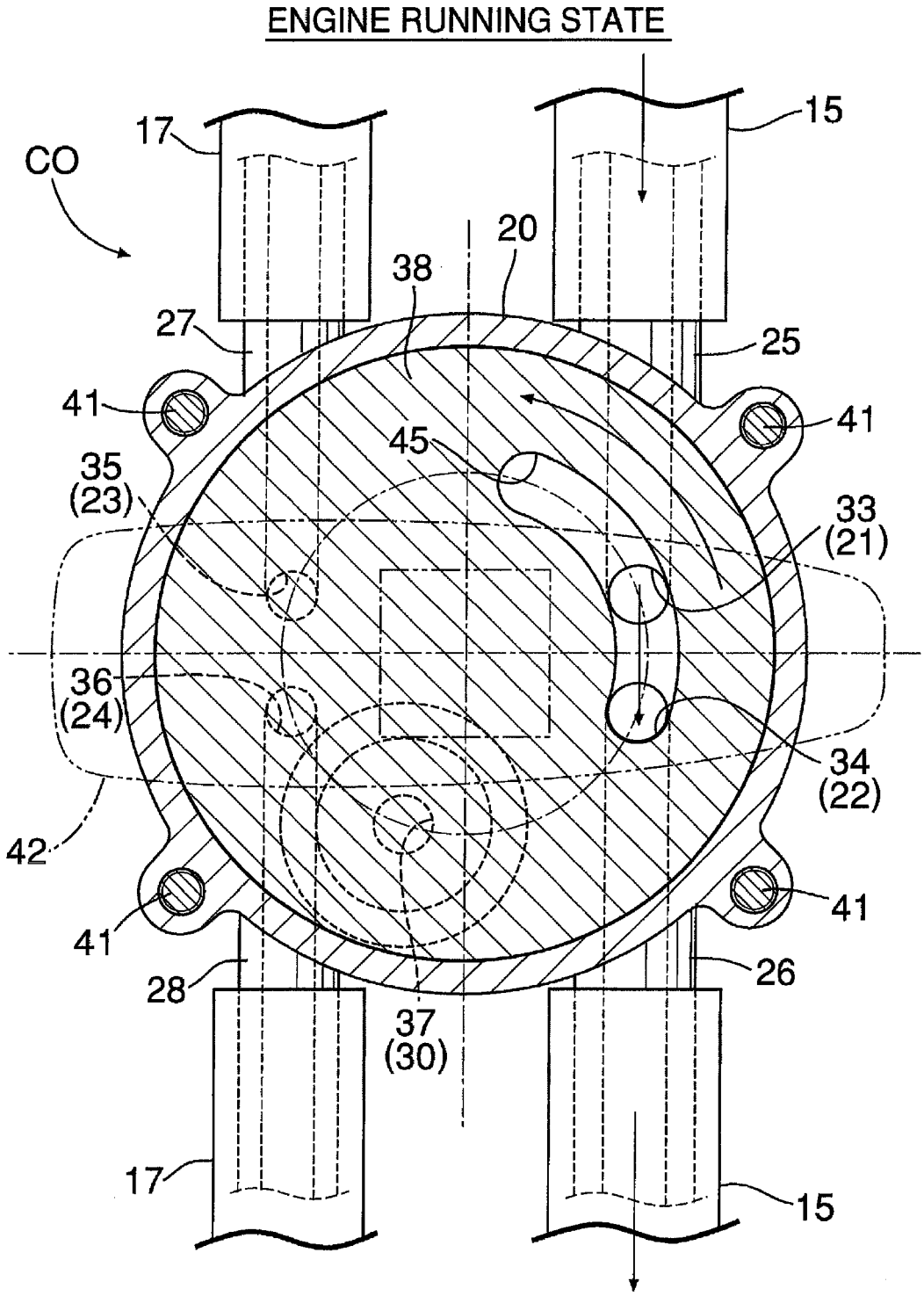
FIG. 6 is a sectional view along line 6-6 in FIG. 3.
Figure 7:
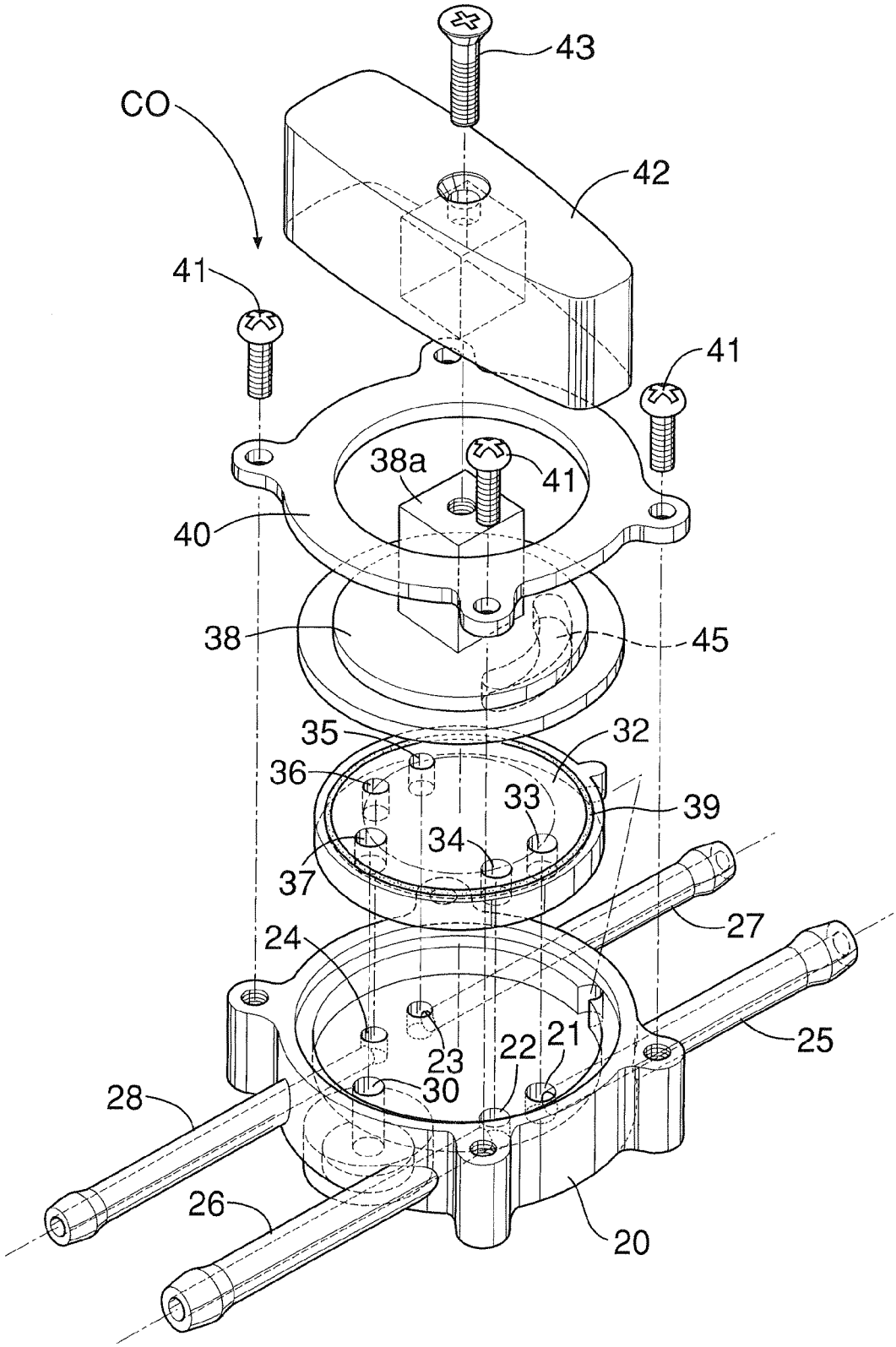
FIG. 7 is an exploded perspective view of a changeover cock.

When the engine E is used, the cock body 38 of the changeover cock CO is held at an open position as shown in FIGS. 2 and 6, and the communication groove 45 of the cock body 38 holds the first port 21 and the second port 22 in a communicating state and the third port 23 and the fourth port 24 in a blocked state. As a result, the fuel supply passage 15 attains a communicating state, and fuel within the fuel tank TF is supplied to the float chamber 10 of the carburetor CA; furthermore, due to the negative pressure passage 17 being blocked, the diaphragm pump PD is in an inoperative state, and the fuel vent passage 16 is in a blocked state. If the engine E is run in this state, intake negative pressure within the intake passage 8 acts on the negative pressure surge tank TS via the downstream side of the negative pressure passage 17, and negative pressure is accumulated in the tank TS.

Figure 8:
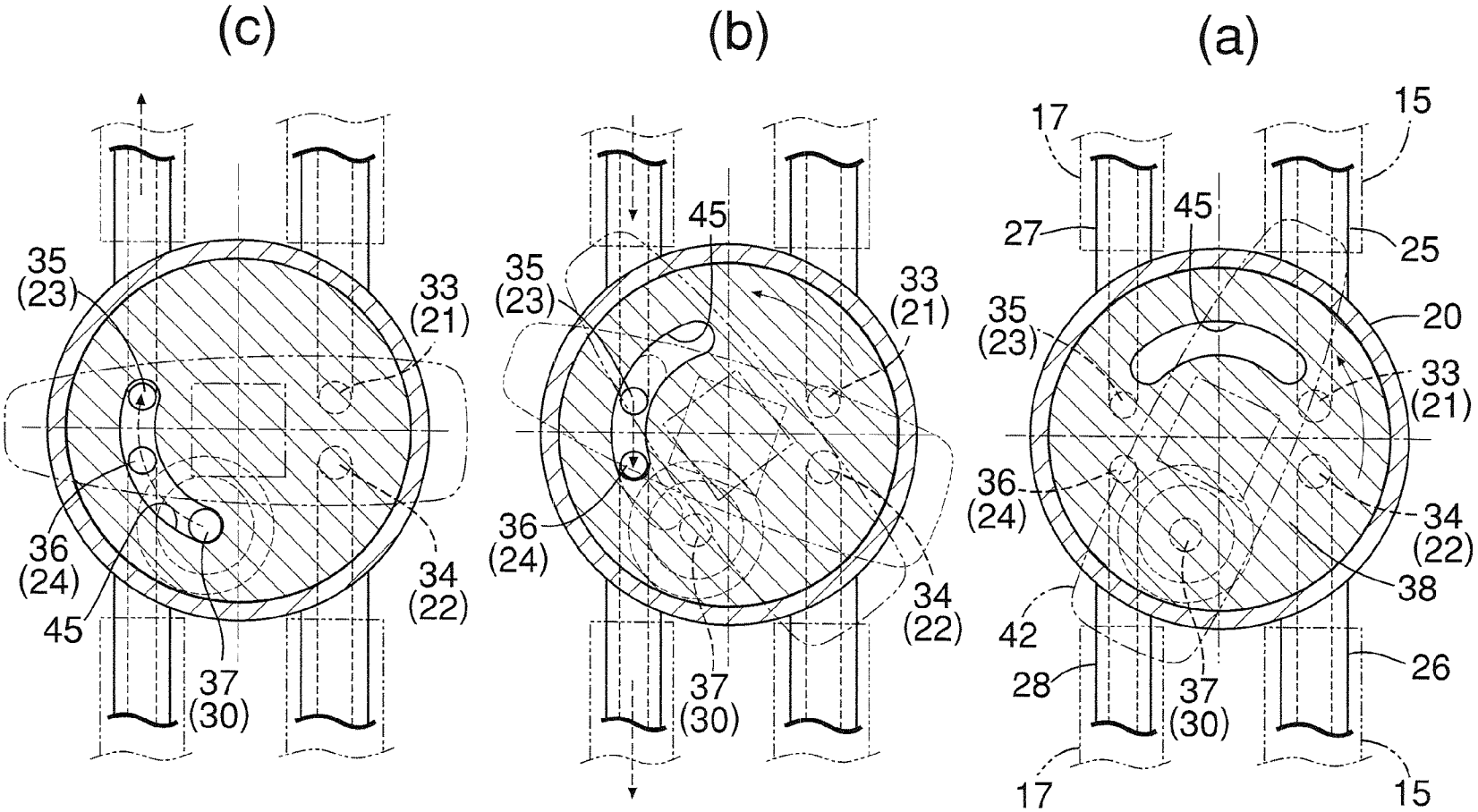
FIG. 8 is a diagram of the operation of the changeover cock of the first embodiment.

Subsequently, when an engine switch, not illustrated, of the engine E is turned OFF, the cock body 38 of the changeover cock CO is pivoted in an anticlockwise direction from the running position of FIG. 6 and held at a closed position as shown in FIG. 8(*a*). This puts the communication groove 45 of the cock body 38 of the cock CO into an intermediate position between the first and second ports 21 and 22 and the third and fourth ports 23 and 24; since the cock body 38 puts both the first and second ports 21 and 22 and the third and fourth ports 23 and 24 into a blocked state, the fuel supply passage 15 attains a blocked state, the supply of fuel from the fuel tank TF to the float chamber 10 is cut off and, furthermore, since the negative pressure passage 17 continues to be in a blocked state, the diaphragm pump PD is maintained in an inoperative state. In this case, the engine E still continues to run by means of residual fuel within the float chamber 10.

Subsequently, when the changeover cock CO is pivoted in an anticlockwise direction as shown from FIG. 8(*a*) to (*b*), the cock body 38 of the cock CO blocks the first and second ports 21 and 22 and provides communication between the third and fourth port 23 and 24 while maintaining the fuel supply passage 15 in a blocked state, thus putting the negative pressure passage 17 into a communicating state; negative pressure already accumulated within the negative pressure surge tank TS therefore flows through the negative pressure passage 17 and acts on the negative pressure operating chamber 53 of the diaphragm pump PD, thus putting the pump PD into an operating state. This allows the diaphragm pump PD to draw up residual fuel within the float chamber 10 to the pump chamber 52.

Subsequently, when the changeover cock CO cock body 38 is pivoted further in the anticlockwise direction as shown from FIG. 8(*b*) to (*c*), the communication groove 45 of the cock body 38 makes the negative pressure passage 17 communicate with the atmosphere communication opening 30 while maintaining the negative pressure passage 17 in a communicating state. This allows the negative pressure operating chamber 53 of the diaphragm pump PD to communicate with the atmosphere through the negative pressure passage 17, the diaphragm 51 of the diaphragm pump PD is displaced downward by virtue of the resilient force of the diaphragm spring 54, fuel drawn up to the pump chamber 52 can be fed under pressure to the breather-equipped fuel tank TF through the fuel vent passage 16, and this enables residual fuel within the float chamber 10 to be returned to the fuel tank TF through the fuel vent passage 16.

In accordance with the venting of residual fuel within the float chamber 10 by the changeover cock CO, even when the engine E still continues to run after the engine switch is turned OFF, even after running of the engine is completely stopped, and even after some time has elapsed after stopping running, all fuel within the float chamber 10 can reliably be returned to the fuel tank TF by means of the negative pressure maintained within the negative pressure surge tank TS.

As described above, after the engine E is stopped, residual fuel within the interior of the float chamber 10 of the carburetor CA automatically goes, and even when the engine E is stored for a long period of time the above-mentioned problems due to residual fuel within the float chamber 10 can be solved.

A second embodiment of the present invention is now explained by reference to FIGS. 9 and 10.

This second embodiment has some differences from the first embodiment in terms of the arrangement of a changeover cock CO, but the arrangement is otherwise the same as the first embodiment; elements that are the same as those of the first embodiment are denoted by the same reference numerals and symbols.

An arc-shaped first communication groove 145(1) and second communication groove 145(2) are bored in a disk-shaped cock body 38, which is rotatably housed within a cylindrical hollow cock case 20, so as to have the center of rotation of the cock body 38 as their centers and be spaced in the circumferential direction and in the radial direction. The circumferential length of the first communication groove 145(1) is shorter than that of the second communication groove 145(2).

Figure 9:
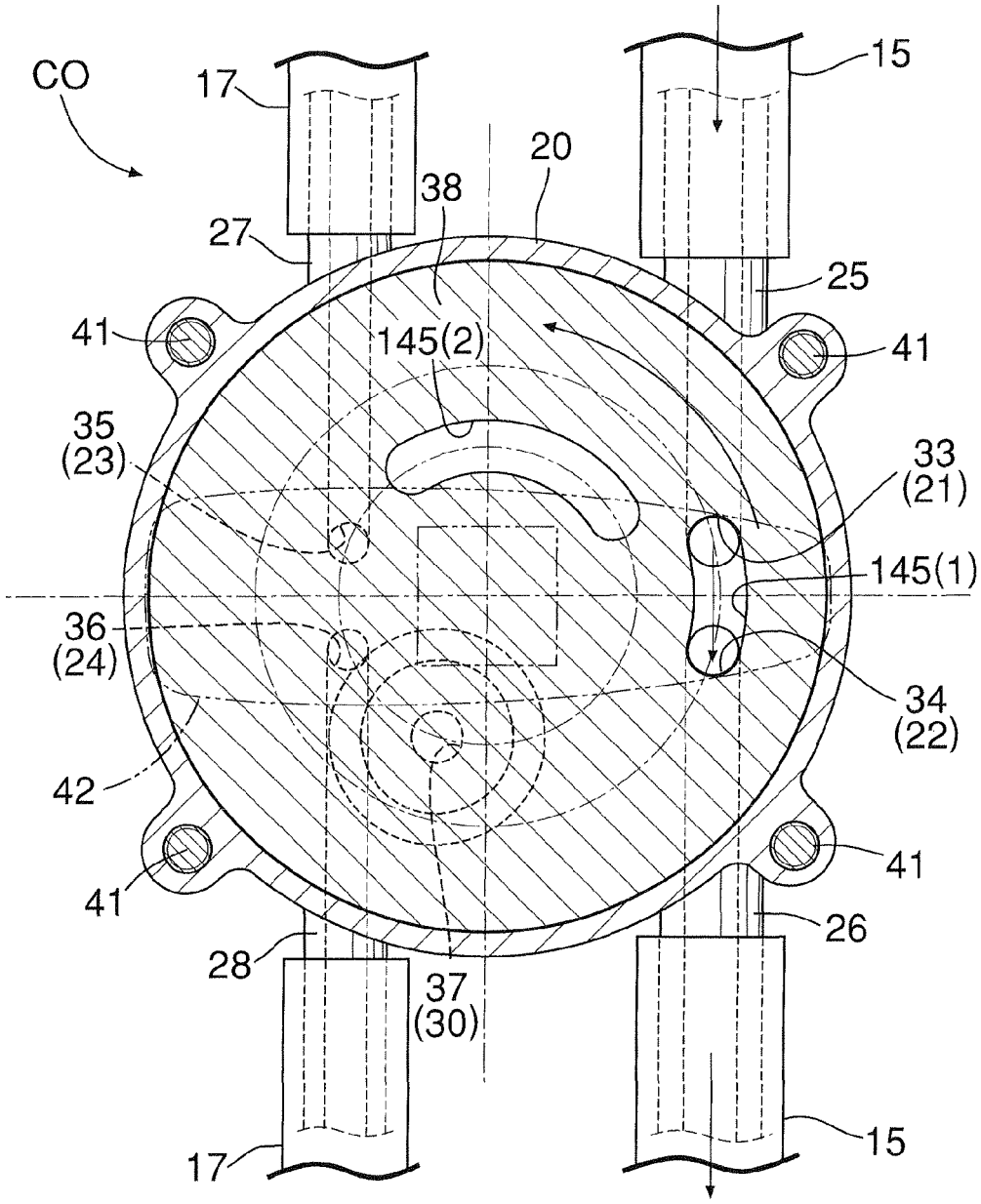
FIG. 9 is a sectional view of a changeover cock related to a second embodiment.

In this second embodiment, residual fuel within a float chamber 10 can be vented while making the angle of rotation of the cock body 38 smaller than that in the first embodiment; when an engine E is running, as shown in FIG. 9, the first communication groove 145(1) of the cock body 38 provides communication between a first port 21 and a second port 22 to thus maintain a fuel supply passage 15 in a communicating state, and the second communication groove 145(2) is at a neutral position in which a third port 23 and a fourth port 24 are blocked and a negative pressure passage 17 is in a blocked state. Therefore, in accordance with running of the engine E, fuel within a fuel tank TF is supplied to the float chamber 10, intake negative pressure within an intake passage 8 acts on a negative pressure surge tank TS, and negative pressure is accumulated in the surge tank TS.

Figure 10:
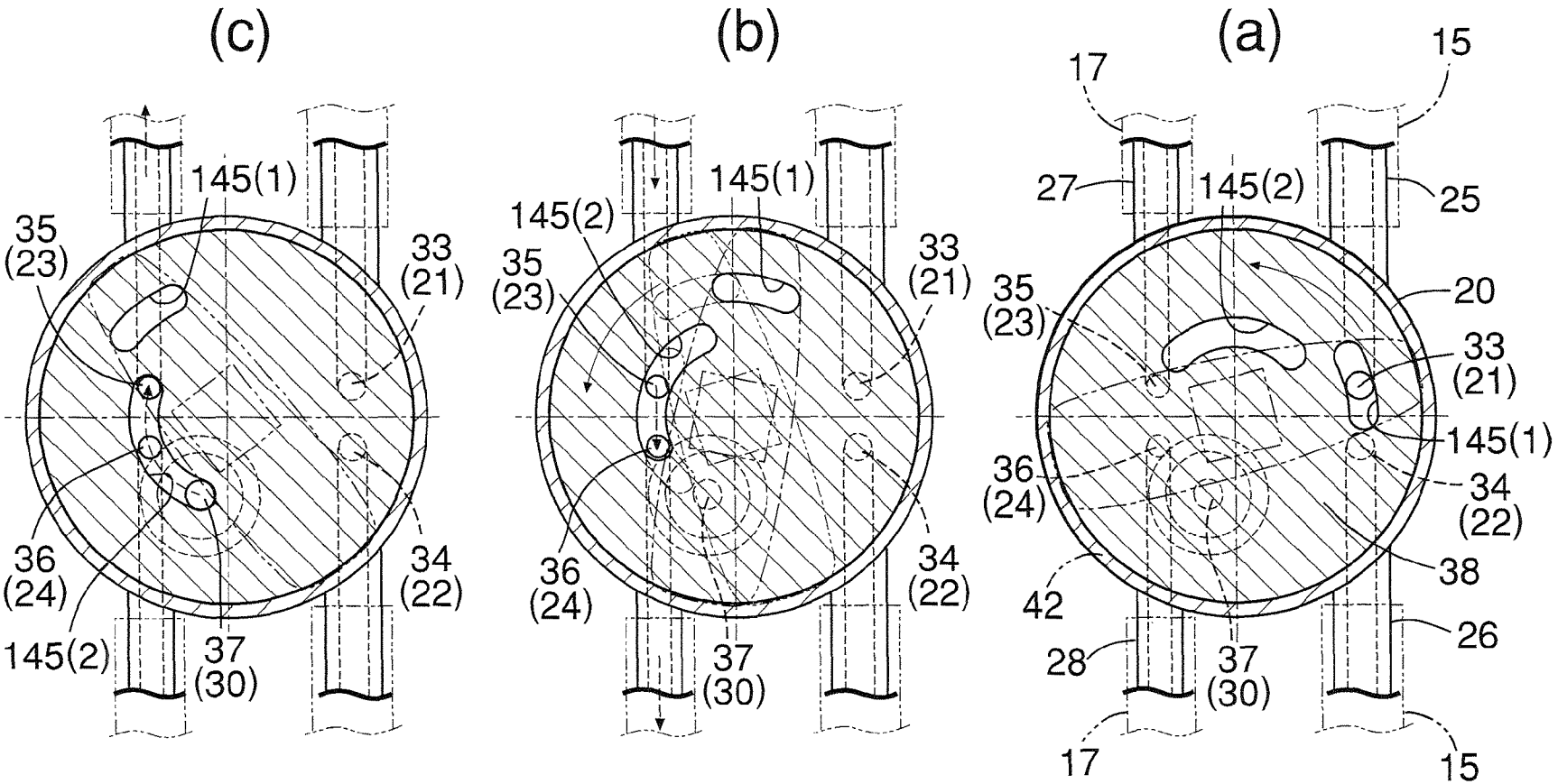
FIG. 10 is a diagram of the operation of the changeover cock of the second embodiment.

When an engine switch of the engine E is OFF, the cock body 38 of a changeover cock CO is pivoted in an anticlockwise direction in FIG. 6 from the above running position and is held at a closed position as shown in FIG. 10(*a*). This brings both the first communication groove 145(1) and the second communication groove 145(2) of the cock body 38 of the cock CO into a neutral position, the cock body 38 puts the first port 21 and second port 22 and the third port 23 and fourth port 24 into a blocked state, the fuel supply passage 15 attains a blocked state, the supply of fuel from the fuel tank TF to the float chamber 10 is cut off, and since the negative pressure passage 17 continues to be in a blocked state, a diaphragm pump PD is maintained in an inoperative state.

Subsequently, when the cock body 38 of the changeover cock CO is pivoted in an anticlockwise direction as shown from FIG. 10(*a*) to (*b*), while the first communication groove 145(1) is at a neutral position, the second communication groove 145(2) provides communication between the third port 23 and the fourth port 24 to thus put the negative pressure passage 17 into a communicating state while maintaining the fuel supply passage 15 in a blocked state, and negative pressure already accumulated within the negative pressure surge tank TS acts on the negative pressure operating chamber 53 of the diaphragm pump PD through the negative pressure passage 17, thus putting the diaphragm pump PD into an active state. This allows the diaphragm pump PD to draw up residual fuel within the float chamber 10 into a pump chamber 52 through a fuel vent passage 16.

Subsequently, the cock body 38 of the changeover cock CO is pivoted further in the anticlockwise direction as shown from FIG. 10(*b*) to (*c*), and the second communication groove 145(2) of the cock body 38 provides communication between the negative pressure passage 17 and an atmosphere communication opening 30 while maintaining the negative pressure passage 17 in a communicating state. This allows the negative pressure operating chamber 53 of the diaphragm pump PD to communicate with the atmosphere through the negative pressure passage 17, a diaphragm 51 of the diaphragm pump PD is displaced downward by virtue of the resilient force of a diaphragm spring 54 so that fuel that has been drawn up into the pump chamber 52 is fed under pressure into the fuel tank TF through the fuel vent passage 16, and this enables residual fuel within the float chamber 10 to be returned to the fuel tank TF through the fuel vent passage 16.

The arrangement of this second embodiment therefore exhibits the same operational effects as those of the first embodiment and, moreover, since the cock body 38 of the changeover cock CO is provided with the first communication groove 145(1) for exclusively providing or blocking communication of the fuel supply passage 15 and the second communication groove 145(2) for exclusively providing or blocking communication of the negative pressure passage 17, it is possible to return residual fuel within the float chamber 10 to the fuel tank TF through the fuel vent passage 16 with a small angle of rotation of the cock body 38 compared with the arrangement of the first embodiment.

A third embodiment of the present invention is now explained by reference to FIGS. 11 and 12.

This third embodiment has some differences from the first and second embodiments in terms of the arrangement of a changeover cock CO, but elements that are the same as those of the first and second embodiments are denoted by the same reference numerals and symbols.

One arc-shaped communication groove 245 is bored in a disk-shaped cock body 38 rotatably housed within a hollow cylindrical cock case 20 with the center of rotation of the cock body 38 as its center; the circumferential length of the communication groove 245 is shorter than that of the communication groove 45 of the first embodiment, and an atmosphere communication opening 30 provided in the cock body 38 on a concentric circle with first to fourth ports 21 to 24 is positioned in the vicinity of the third port 23. When venting fuel, the cock body 38 is rotated in a clockwise direction in FIGS. 11 and 12. In this third embodiment, by adding a stroke of blocking a negative pressure passage 17 once a diaphragm pump PD is actuated, intake negative pressure can be accumulated in a negative pressure surge tank TS, and residual fuel within a float chamber 10 can reliably be returned to a fuel tank TF even if the capacity of the diaphragm pump PD is made small.

Figure 11:
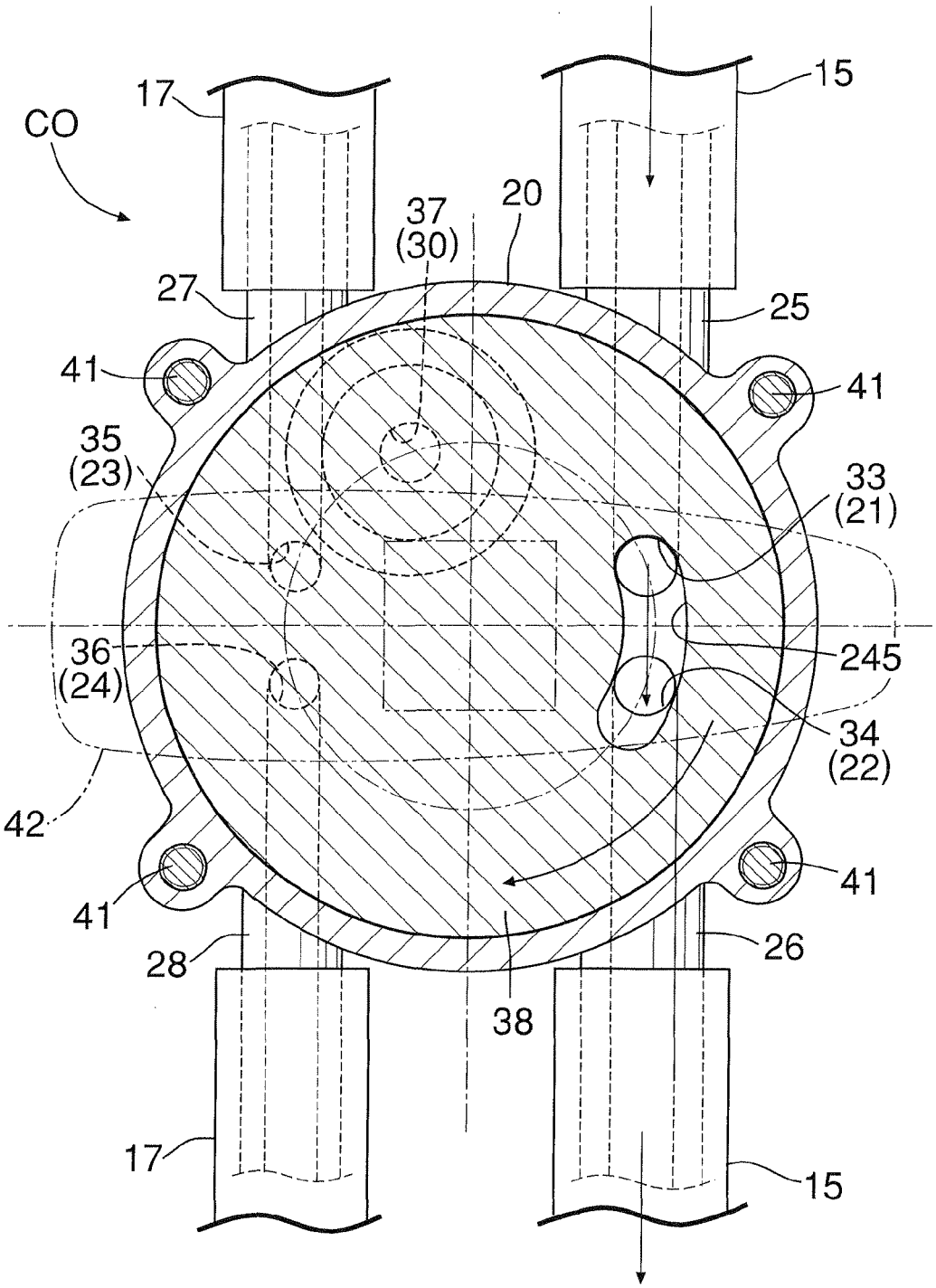
FIG. 11 is a sectional view of a changeover cock related to a third embodiment.

When an engine E is running, as shown in FIG. 11, the communication groove 245 of the cock body 38 provides communication between the first port 21 and the second port 22 to thus maintain a fuel supply passage 15 in a communicating state, the third port 23 and the fourth port 24 are blocked, and the negative pressure passage 17 is in a blocked state. In accordance with running of the engine E, fuel within the fuel tank TF is supplied to the float chamber 10, intake negative pressure within an intake passage 8 acts on the negative pressure surge tank TS, and negative pressure is accumulated in the surge tank TS.

Figure 12:
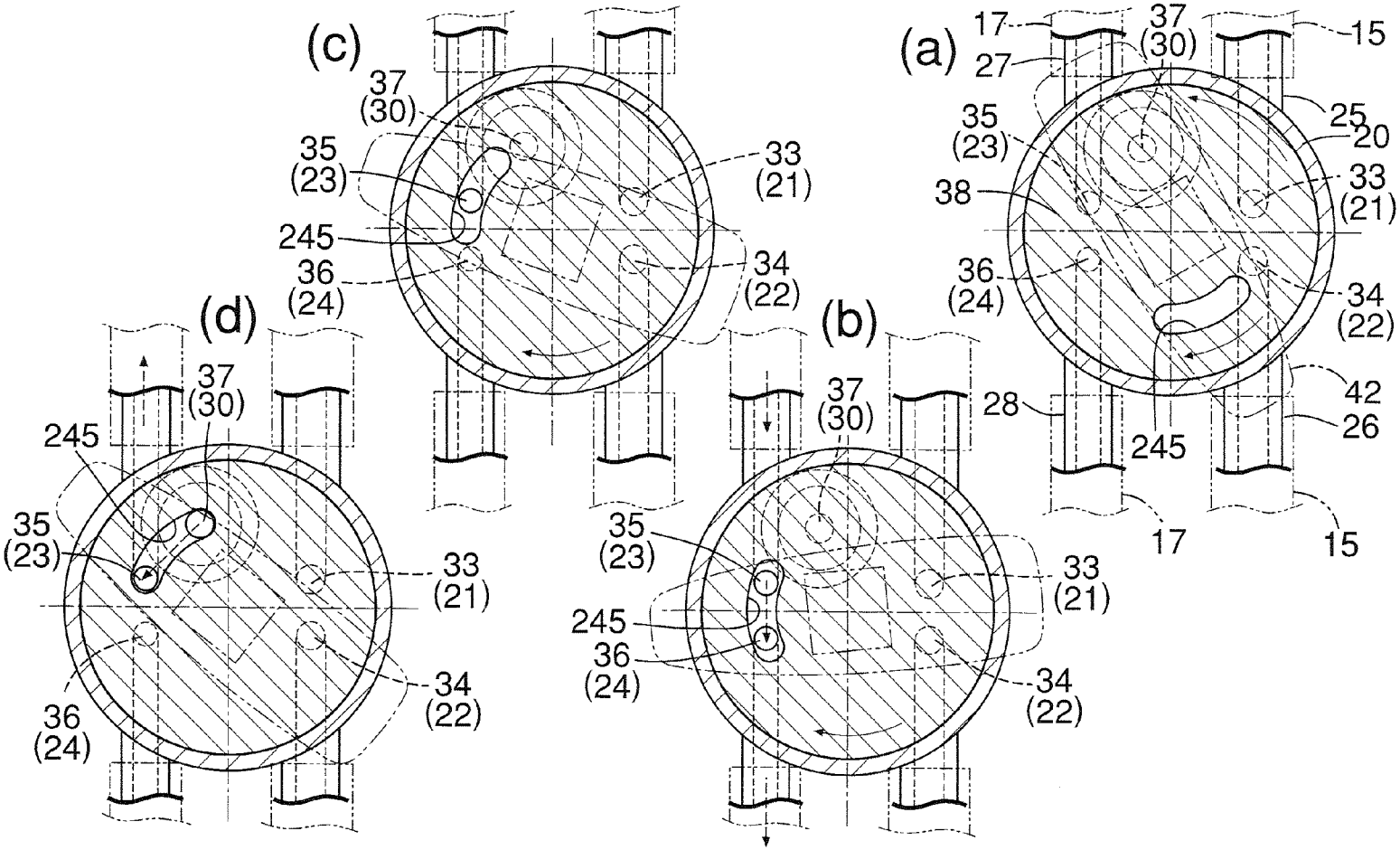
FIG. 12 is a diagram of the operation of the changeover cock of the third embodiment.

When an engine switch of the engine E is OFF, the cock body 38 of the changeover cock CO is pivoted in a clockwise direction from the running position in FIG. 11 and holds the communication groove 245 at a neutral position as shown in FIG. 12(*a*). Since this allows the cock body 38 to put both the first port 21 and second port 22 and the third port 23 and fourth port 24 into a blocked state, the fuel supply passage 15 attains a blocked state, supply of fuel from the fuel tank TF to the float chamber 10 is cut off and, furthermore, since the negative pressure passage 17 continues to be in a blocked state, the diaphragm pump PD is maintained in an inoperative state.

Subsequently, when the cock body 38 of the changeover cock CO is pivoted in a clockwise direction as shown from FIG. 12(*a*) to (*b*), the communication groove 245 provides communication between the third port 23 and the fourth port 24 to thus bring the negative pressure passage 17 into a communicating state while maintaining the fuel supply passage 15 in a blocked state, negative pressure already accumulated within the negative pressure surge tank TS therefore acts on a negative pressure operating chamber 53 of the diaphragm pump PD through the negative pressure passage 17, and the pump PD is put into an active state. This allows the diaphragm pump PD to draw up residual fuel within the float chamber 10 into a pump chamber 52 through a fuel vent passage 16.

Subsequently, when the cock body of the changeover cock CO is pivoted further in a clockwise direction as shown from FIG. 12(*b*) to (*c*), since the communication groove 245 blocks the negative pressure passage 17, communication between the negative pressure surge tank TS and the diaphragm pump PD is blocked, supply of negative pressure from the negative pressure surge tank TS to the diaphragm pump PD is cut off, and negative pressure within the negative pressure surge tank TS is maintained. Furthermore, when the cock body 38 is pivoted in a clockwise direction as shown from FIG. 12(*c*) to (*d*), the communication groove 245 of the cock body 38 provides communication between the atmosphere communication opening 30 and the negative pressure operating chamber 53 of the diaphragm pump PD. This allows the negative pressure operating chamber 53 of the diaphragm pump PD to communicate with the atmosphere, a diaphragm 51 of the diaphragm pump PD is displaced downward by virtue of the resilient force of a diaphragm spring 54 so that fuel that has been drawn up into the pump chamber 52 is fed under pressure to the fuel tank TF through the fuel vent passage 16, and this enables residual fuel within the float chamber 10 to be returned to the fuel tank TF through the fuel vent passage 16.

This third embodiment therefore also exhibits the same operational effects as those of the first embodiment and, moreover, in the fuel venting stroke, by adding the stroke shown in FIG. 12(*c*), since communication between the negative pressure surge tank TS and the diaphragm pump PD is blocked after negative pressure has acted on the diaphragm pump PD, a necessary negative pressure is accumulated in the negative pressure surge tank TS, and it becomes possible to vent fuel by means of the diaphragm pump PD, which has a small capacity. By repeating the operation of the cock body 38 shown in FIGS. 12(*b*), (*c*), and (*d*), venting of fuel can be carried out continuously and efficiently.

A fourth embodiment of the present invention is now explained by reference to FIGS. 13 and 14.

This fourth embodiment has some differences from the third embodiment in terms of the arrangement of a changeover cock CO; specifically the one communication groove 245 of the third embodiment is replaced by a first communication groove 345(1) and a second communication groove 345(2), the arrangement otherwise being the same as that of the third embodiment.

A cock body 38 is provided with an arc-shaped first communication groove 345(1) and second communication groove 345(2) with the center of rotation of the cock body 38 as their centers, these communication grooves 345(1) and 345(2) being displaced in the circumferential direction and the radial direction; the first communication groove 345(1) is present radially outside the second communication groove 345(2), and the circumferential length thereof is slightly longer than that of the second communication groove 345(2).

Figure 13:
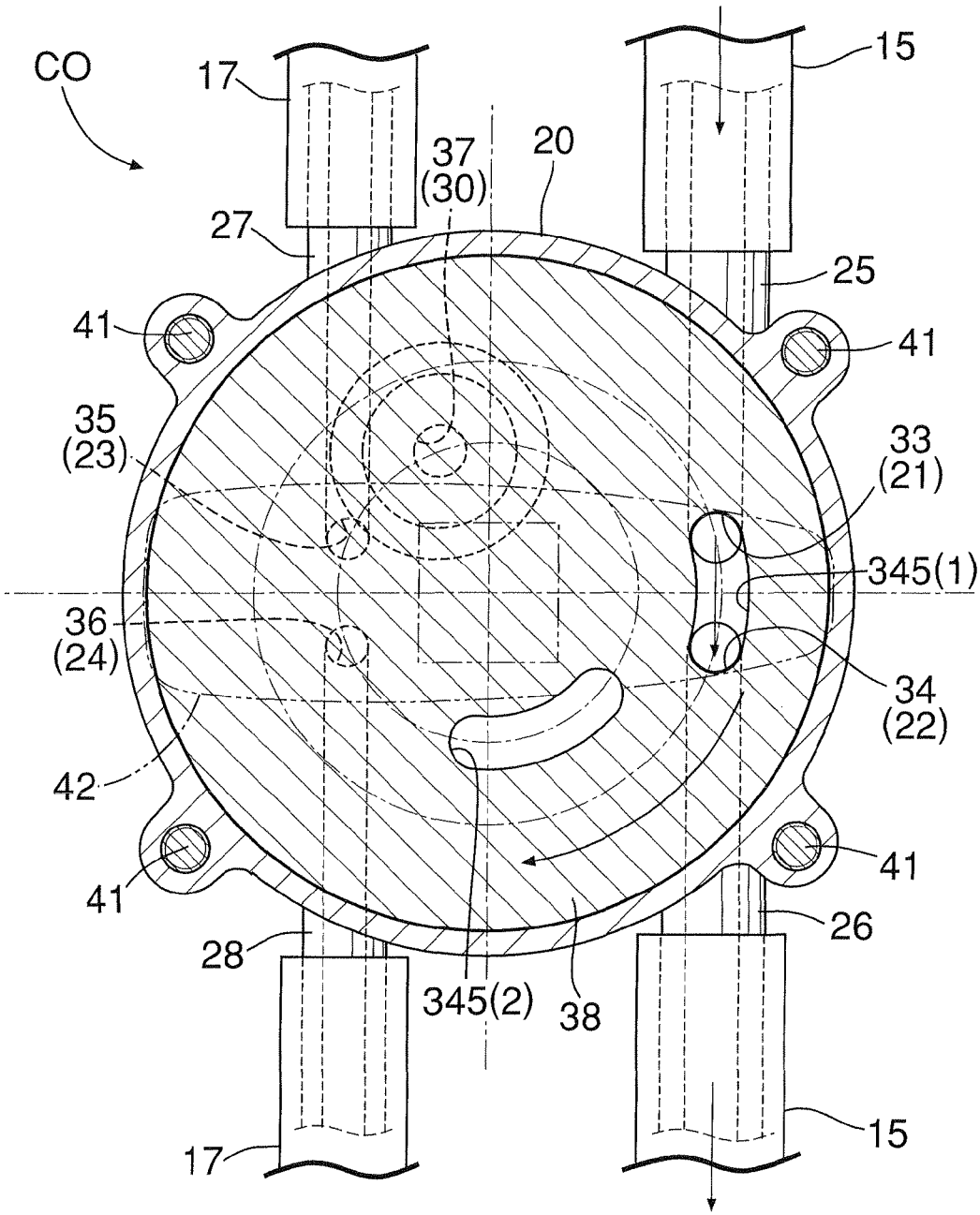
FIG. 13 is a sectional view of a changeover cock related to a fourth embodiment.
Figure 14:
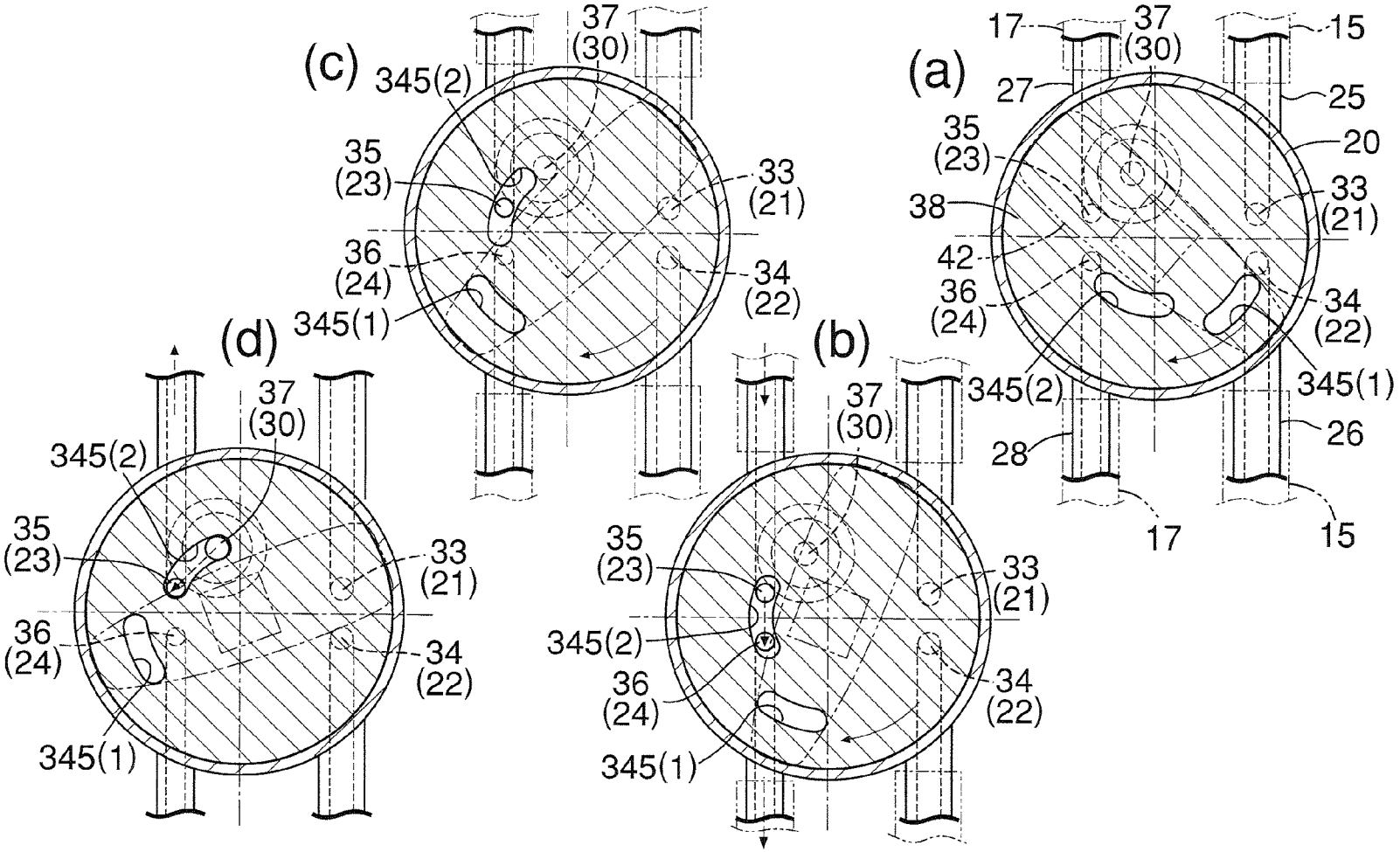
FIG. 14 is a diagram of the operation of the changeover cock of the fourth embodiment.

The cock body 38 is pivoted in a clockwise direction in FIGS. 13 and 14. In the same way as in the third embodiment, by adding a stroke of blocking a negative pressure passage 17 once a diaphragm pump PD is actuated, intake negative pressure can be accumulated in a negative pressure surge tank TS, and residual fuel within a float chamber 10 can reliably be returned to a fuel tank TF even if the capacity of the diaphragm pump PD is made small.

When an engine E is running, as shown in FIG. 13, the first communication groove 345(1) of the cock body 38 provides communication between a first port 21 and a second port 22 to thus maintain a fuel supply passage 15 in a communicating state, the second communication groove 345(2) is at a neutral position, a third port 23 and a fourth port 24 are blocked, and the negative pressure passage 17 is in a blocked state. In accordance with running of the engine E, fuel within the fuel tank TF is supplied to the float chamber 10 and, furthermore, intake negative pressure within an intake passage acts on the negative pressure surge tank TS, and negative pressure is accumulated in the surge tank TS.

When an engine switch of the engine E is OFF, the cock body of the changeover cock CO is pivoted in a clockwise direction from the running position of FIG. 13 and, as shown in FIG. 14(*a*), both the first and second communication grooves 345(1) and 345(2) are maintained at a neutral position. This allows the cock body 38 to put both the first port 21 and second port 22 and the third port 23 and fourth port 24 into a blocked state, the fuel supply passage 15 attains a blocked state, supply of fuel from the fuel tank TF to the float chamber 10 is cut off, and since the negative pressure passage 17 continues in its blocked state, the diaphragm pump PD is maintained in an inoperative state.

Subsequently, when the cock body 38 of the changeover cock CO is pivoted in a clockwise direction as shown from FIG. 14(*a*) to (*b*), the second communication groove 345(2) provides communication between the third port 23 and the fourth port 24, the negative pressure passage 17 is put into a communicating state while maintaining the fuel supply passage 15 in a blocked state, and negative pressure already accumulated within the negative pressure surge tank TS acts on a negative pressure operating chamber 53 of the diaphragm pump PD through the negative pressure passage 17 to thus put the pump PD into an active state. This allows the diaphragm pump PD to draw up residual fuel within the float chamber 10 into a pump chamber 52 through a fuel vent passage 16.

Subsequently, when the cock body 38 of the changeover cock CO is further pivoted in a clockwise direction as shown from FIG. 14(*b*) to (*c*), since the second communication groove 345(2) moves to a position where the negative pressure passage 17 is blocked, communication between the negative pressure surge tank TS and the diaphragm pump PD is blocked, supply of negative pressure from the negative pressure surge tank TS to the diaphragm pump PD is cut off, and negative pressure within the negative pressure surge tank TS is conserved. When the cock body is pivoted further in a clockwise direction as shown from FIG. 14(*c*) to (*d*), the second communication groove 345(2) provides communication between an atmosphere communication opening 30 and the negative pressure operating chamber 53 of the diaphragm pump PD through the negative pressure passage 17. This allows the negative pressure operating chamber 53 of the diaphragm pump PD to communicate with the atmosphere, a diaphragm 51 of the diaphragm pump PD is displaced downward by virtue of the resilient force of a diaphragm spring 54 so that fuel that has been drawn up into the pump chamber 52 is fed under pressure into the fuel tank TF through the fuel vent passage 16, and this enables residual fuel within the float chamber 10 to be returned to the fuel tank TF through the fuel vent passage 16.

This fourth embodiment therefore exhibits the same operational effects as those of the first embodiment and, moreover, in the stroke of venting fuel, by adding the stroke shown in FIG. 14(*c*), since communication between the negative pressure surge tank TS and the diaphragm pump PD is blocked after negative pressure has acted on the diaphragm pump PD, a necessary negative pressure is accumulated in the negative pressure surge tank TS, and it becomes possible to vent fuel by means of the diaphragm pump PD, which has a small capacity. By repeating the operation of the cock body shown in FIGS. 14(*b*), (*c*), and (*d*), venting of fuel can be carried out continuously and efficiently.

A fifth embodiment of the present invention is now explained by reference to FIG. 15.

Figure 15:
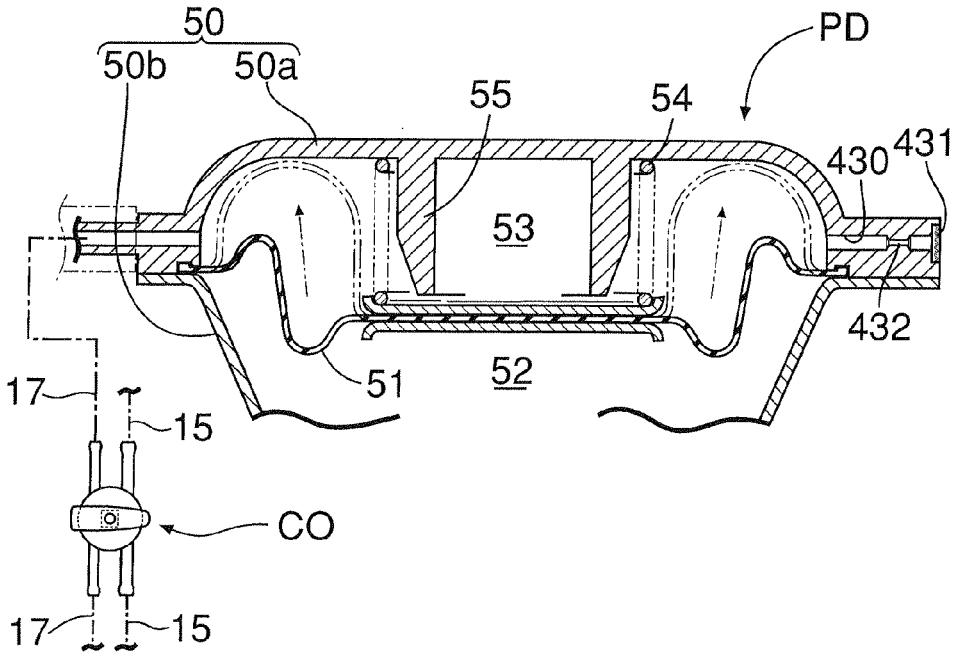
FIG. 15 is a sectional view of part of a diaphragm pump related to a fifth embodiment.

In FIG. 15, elements that are the same as those of the first to fourth embodiments above are denoted by the same reference numerals and symbols.

In this fifth embodiment, instead of the atmosphere communication opening 30 provided in the cock body 38 of the changeover cock CO in the first to fourth embodiments, an atmosphere communication passage 430 communicating with a negative pressure operating chamber 53 is provided in a pump case 50 of a diaphragm pump PD. A fixed orifice 432 is provided partway along the atmosphere communication passage 430, and a filter 431 is provided in an opening thereof. When a changeover cock CO puts a negative pressure passage 17 into a communicating state, negative pressure within a negative pressure surge tank TS acts on the negative pressure operating chamber 53 of the diaphragm pump PD through the negative pressure passage 17, a diaphragm 51 is displaced as shown by a double dotted broken line in FIG. 15, and residual fuel of a float chamber 10 is drawn into a pump chamber 52 of the pump PD. Subsequently, when the changeover cock CO causes the negative pressure passage 17 to be blocked, negative pressure within the negative pressure operating chamber 53 of the diaphragm pump PD is gradually released to the atmosphere through the atmosphere communication passage 430, and the negative pressure is gradually released; this allows the diaphragm 51 of the diaphragm pump PD to be displaced downward as shown by a solid line in FIG. 15, and fuel drawn into the pump chamber 52 is fed under pressure into a fuel tank TF through a fuel vent passage 16.

In accordance with the fifth embodiment, it is therefore unnecessary to provide an atmosphere communication opening 30 in the cock body 38 of the changeover cock CO, and it is also unnecessary to rotate the cock body 38 toward the atmosphere communication side.

A sixth embodiment of the present invention is now explained by reference to FIG. 16.

Figure 16:
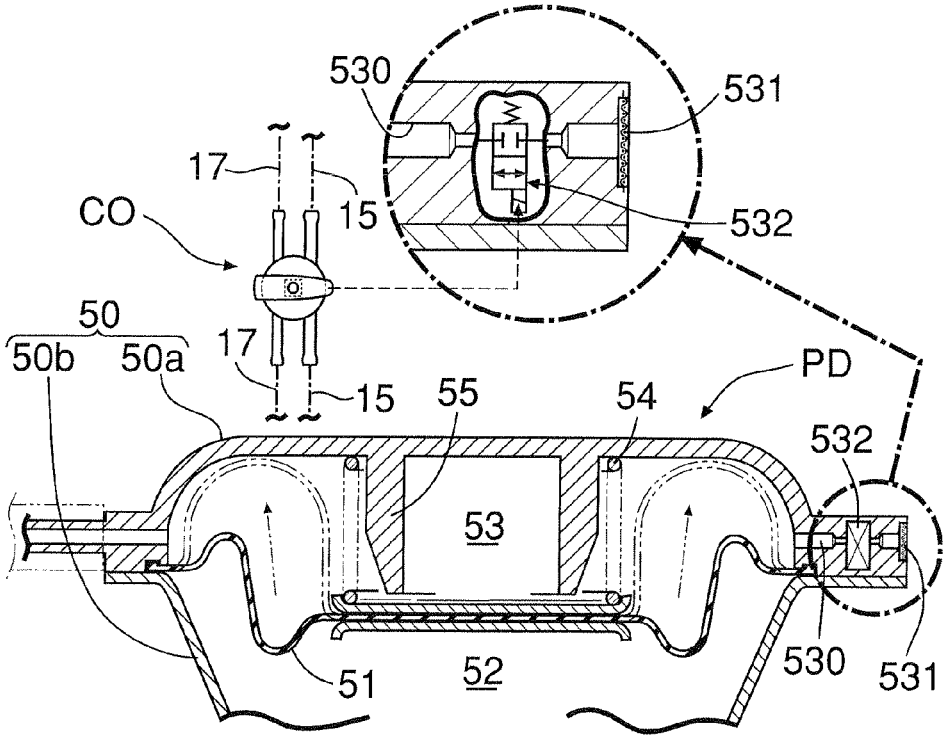
FIG. 16 is a sectional view of part of a diaphragm pump related to a sixth embodiment.

In FIG. 16, elements that are the same as those of the first to fifth embodiments above are denoted by the same reference numerals and symbols.

In this sixth embodiment, instead of the atmosphere communication opening 30 provided in the cock body 38 of the changeover cock CO in the first to fourth embodiments, an atmosphere communication passage 530 communicating with a negative pressure operating chamber 53 is provided in a pump case 50 of a diaphragm pump PD. A solenoid open/close valve 532 is provided partway along the atmosphere communication passage 530, and this solenoid open/close valve 532 is normally held at a closed position and is opened upon reception of an operating signal from a changeover cock CO. Furthermore, a filter 531 is provided on an opening of the atmosphere communication passage.

When the changeover cock CO puts a negative pressure passage 17 into a communicating state, negative pressure within a negative pressure surge tank TS acts on a negative pressure operating chamber 53 of a diaphragm pump PD through the negative pressure passage 17, a flexible diaphragm is displaced as shown by a double dotted broken line in FIG. 16, and residual fuel of a float chamber 10 is drawn into a pump chamber 52 of the pump PD. In accordance with subsequent blocking of the negative pressure passage 17 by the changeover cock CO, the solenoid open/close valve 532 is opened in association therewith, and negative pressure within the negative pressure operating chamber 53 of the diaphragm pump PD is gradually released to the atmosphere through the atmosphere communication passage 531; this allows the diaphragm 51 to be displaced downward as shown by a solid line in FIG. 16, and fuel drawn into the pump chamber 52 is fed under pressure into a fuel tank TF through a fuel vent passage 16.

In accordance with the sixth embodiment, it is therefore unnecessary to provide an atmosphere communication opening 30 in the cock body 38 of the changeover cock CO, and it is also unnecessary to rotate the cock body 38 toward the atmosphere communication side.

A seventh embodiment of the present invention is now explained by reference to FIG. 17.

Figure 17:
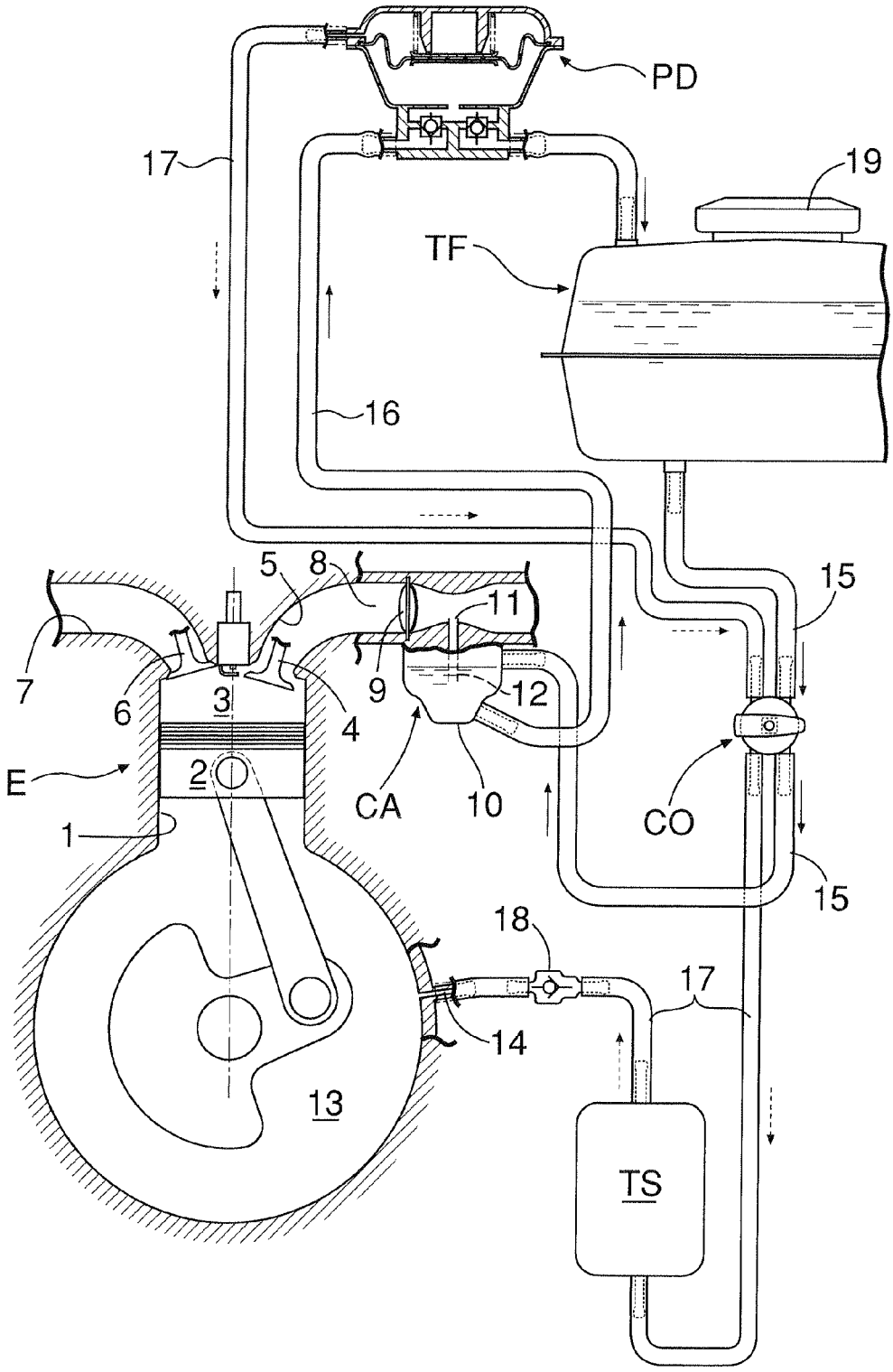
FIG. 17 is an overall schematic diagram of an automatic residual fuel vent device for a carburetor related to a seventh embodiment.

In FIG. 17, elements that are the same as those of the first to sixth embodiments are denoted by the same reference numerals and symbols.

In all of the first to sixth embodiments, negative pressure for operating the automatic residual fuel vent device of the carburetor CA is extracted from the intake passage 8 of a ventilation system of the engine E, but in this seventh embodiment negative pressure is extracted from a crank chamber 13 of an engine E, the arrangement otherwise being the same as that of the first embodiment. A negative pressure extraction hole 14 is opened in one side of the crank chamber 13, and a negative pressure passage 17 communicating with a negative pressure surge tank TS is connected to the negative pressure extraction hole 14.

Negative pressure within the crank chamber 13 generated by running of the engine E is accumulated in the negative pressure surge tank TS via a one-way valve 18, and is used as a power source for automatic venting of residual fuel of a carburetor CA.

An eighth embodiment of the present invention is now explained by reference to FIG. 18A, and FIG. 19 to FIG. 22.

In each of the drawings of FIG. 18A, and FIG. 19 to FIG. 22, elements that are the same as those of the first embodiment are denoted by the same reference numerals and symbols.

This eighth embodiment is a case in which the diaphragm pump PD of the first to seventh embodiments is omitted, and a fuel tank TF is formed as a hermetically sealed (air-tight) type in which no breather is provided in a fuel cap 19.

A lower part of the hermetically sealed type fuel tank TF, which is disposed at a position higher than an engine E, and a float chamber 10 of a carburetor CA are connected to each other via a fuel supply passage 15, a changeover cock CO for opening and closing the fuel supply passage 15 is provided partway along the fuel supply passage 15, and in accordance with control of changeover of the changeover cock CO, fuel within the fuel tank TF is supplied to the interior of the float chamber 10 by falling under gravity.

Furthermore, an upper part of a hermetically sealed air chamber A of the fuel tank TF is directly connected to a lower part of the float chamber 10 via a fuel vent passage 16. The downstream side, relative to a throttle valve 9, of an intake passage 8 of the engine E is connected to an upper part of the hermetically sealed air chamber A of the fuel tank TF via a negative pressure passage 17, and a hermetically sealed negative pressure surge tank TS for storing negative pressure is connected partway along the negative pressure passage 17. A one-way valve 18 for preventing backflow of negative pressure is provided partway along the negative pressure passage 17 between the negative pressure surge tank TS and the intake passage 8, and the changeover cock CO is provided in the negative pressure passage 17 between the negative pressure surge tank TS and the fuel tank TF.

The changeover cock CO has substantially the same structure as that of the first embodiment, but the structure of first and second communication grooves 745(1) and 745(2) provided in a cock body 38 is different from that of the first embodiment. The arc-shaped first communication groove 745(1) and second communication groove 745(2) are provided in the disk-shaped cock body 38, which is rotatably provided within a cock case 20 of the changeover cock CO, on concentric circles with the center of rotation of the cock body 38 as their center so as to be spaced in the circumferential direction; the first communication groove 745(1) can provide or block communication between first and second ports 21 and 22 provided in the cock case 20, the second communication groove 745(2) can provide or block communication between third and fourth ports 23 and 24, and the cock case 20 is provided with an atmosphere communication opening 30 in the vicinity of the third port 23, this atmosphere communication opening 30 being capable of communicating with the second communication groove 745(2).

Figure 21:
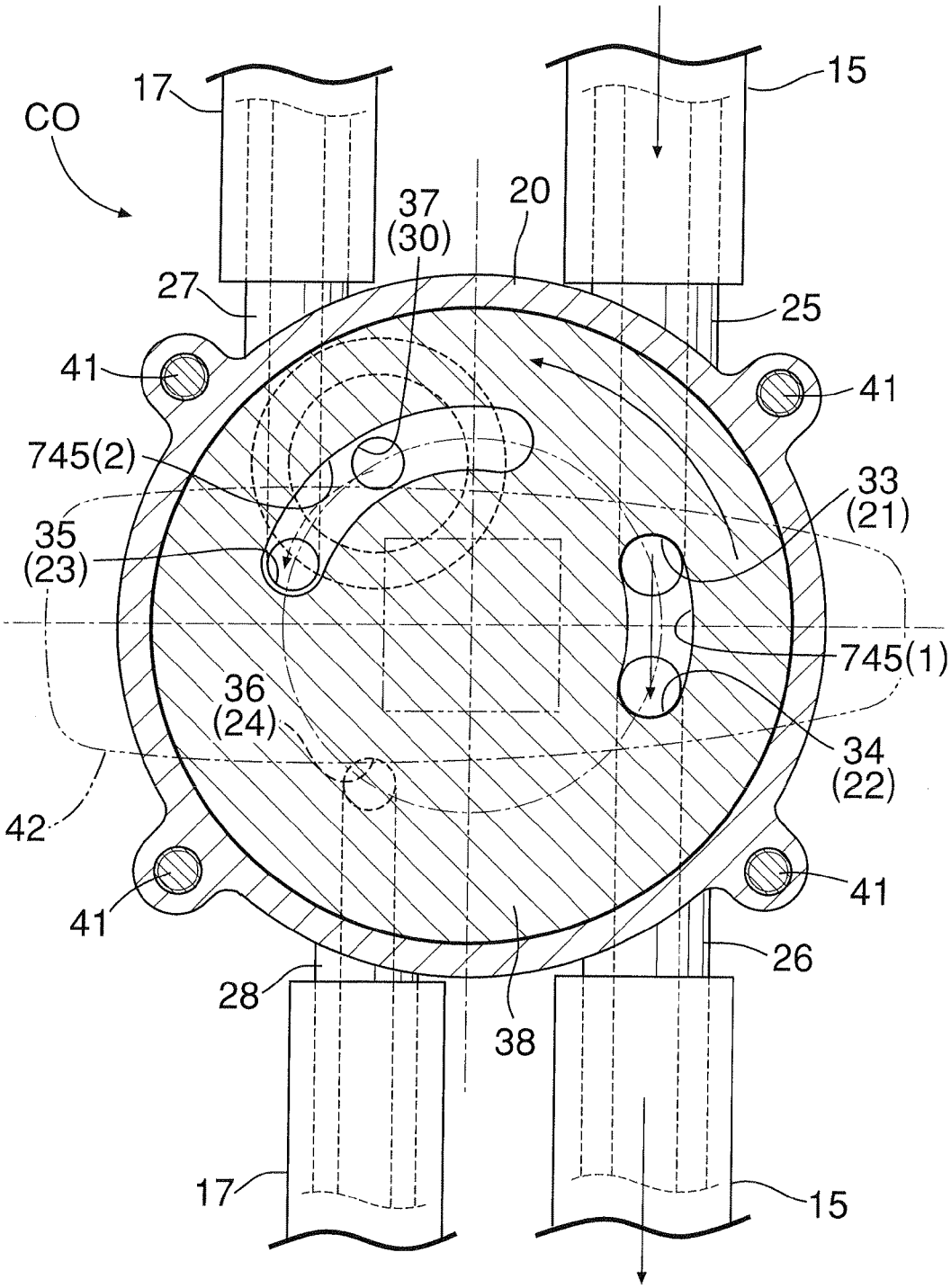
FIG. 21 is a sectional view along line 21-21 in FIG. 20.

When the engine E is used, the cock body 38 of the changeover cock CO is held at an open position shown in FIG. 21, and the first communication groove 745(1) of the cock body 38 holds the first port 21 and the second port 22 in a communicating state. Furthermore, the third port 23 and the fourth port 24 are maintained in a blocked state and, moreover, the second communication groove 745(2) provides communication between the third port 23 and the atmosphere communication opening 30. This allows the fuel supply passage 15 to attain a communicating state, fuel within the fuel tank TF is supplied to the float chamber 10 of the carburetor CA, and the hermetically sealed air chamber A of the fuel tank TF communicates with the atmosphere. When the engine E starts to run in this state, intake negative pressure within the intake passage 8 acts on the negative pressure surge tank TS via the negative pressure passage 17, and negative pressure accumulates in the tank TS.

Figure 22:
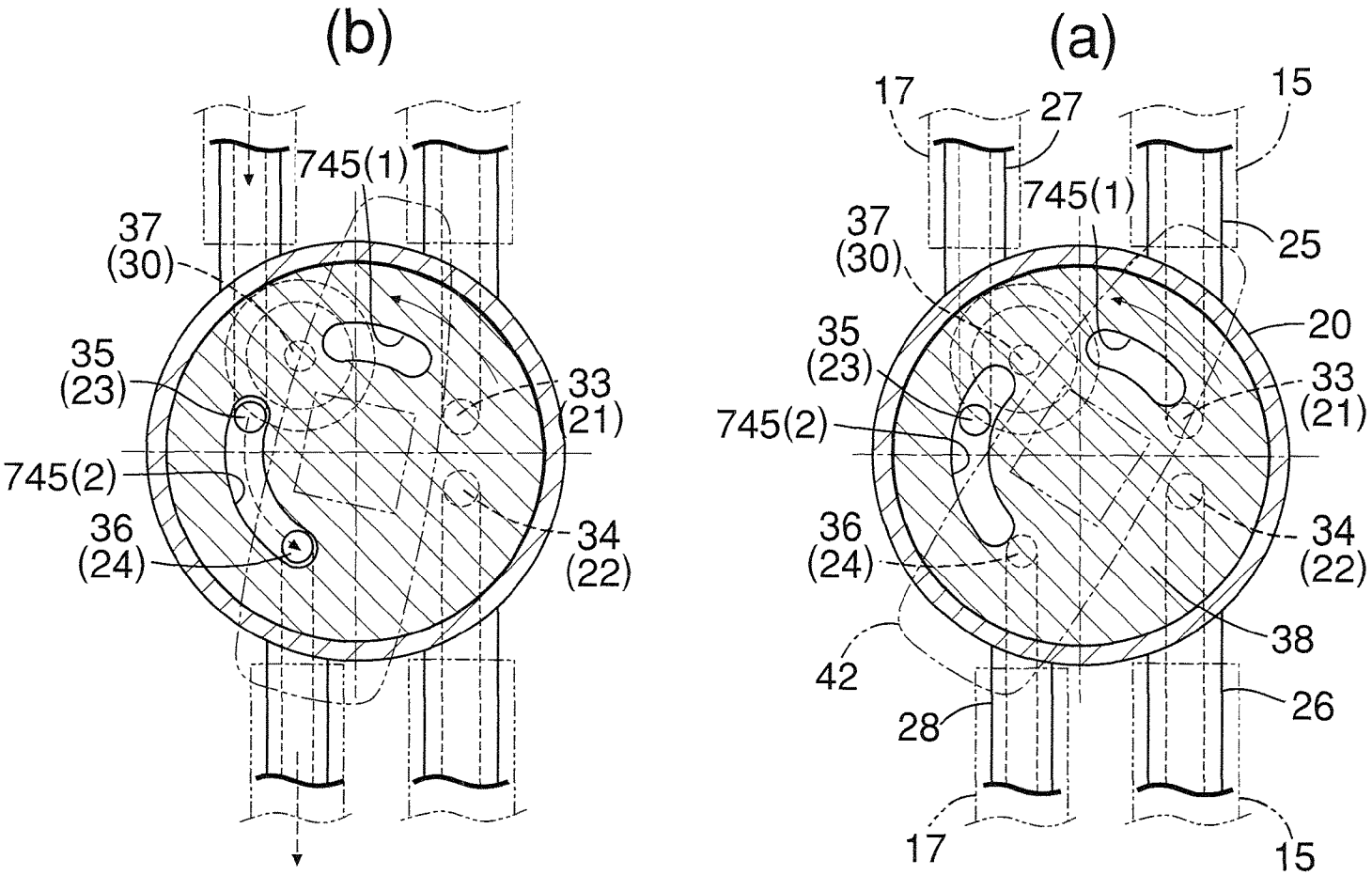
FIG. 22 is a diagram of the operation of a changeover cock of the eighth embodiment.

Subsequently, when an engine switch of the engine E is OFF, the cock body 38 of the changeover cock CO is pivoted in an anticlockwise direction from the running position shown in FIG. 21, and held at a closed position as shown in FIG. 22(*a*). This allows the first and second communication grooves 745(1) and 745(2) of the cock body 38 of the changeover cock C to attain a neutral position, the cock body 38 puts both the first port 21 and second port 22 and the third port 23 and fourth port 24 into a blocked state, the fuel supply passage 15 therefore attains a blocked state, supply of fuel from the fuel tank TF to the float chamber 10 is cut off, the negative pressure passage 17 maintains a blocked state, and the communicating state of the hermetically sealed air chamber A of the fuel tank TF with the atmosphere is cut off.

Subsequently, pivoting the cock body 38 of the changeover cock CO in an anticlockwise direction as shown from FIG. 22(*a*) to (*b*) allows the cock body 38 to block the first port 21 and the second port 22 and provide communication between the third port 23 and the fourth port 24 while maintaining the fuel supply passage 15 in a blocked state to thus put the negative pressure passage 17 into a communicating state, and negative pressure already accumulated within the negative pressure surge tank TS acts directly on the hermetically sealed air chamber A of the fuel tank TF through the negative pressure passage 17 to thus put the air chamber A into a high negative pressure state. This enables residual fuel within the float chamber 10 to be drawn up into the air chamber A of the fuel tank TF.

As described above, pivoting of the changeover cock CO enables negative pressure within the negative pressure surge tank TS to act directly on the hermetically sealed air chamber A of the fuel tank TF, and this enables residual fuel within the float chamber 10 of the carburetor CA to be automatically returned to the fuel tank TF.

In accordance with venting of residual fuel within the float chamber 10 by the changeover cock CO, even when the engine E continues to run after the engine switch is turned OFF, even after running of the engine is completely stopped, and even after some time has elapsed after stopping running, all fuel within the float chamber 10 can reliably be returned to the fuel tank TF by means of the negative pressure maintained within the negative pressure surge tank TS.

As described above, after the engine E is stopped, residual fuel within the float chamber 10 of the carburetor CA automatically goes, and even when the engine E is stored for a long period of time, the above-mentioned problems due to residual fuel within the float chamber 10 can be solved.

Figure 18A:
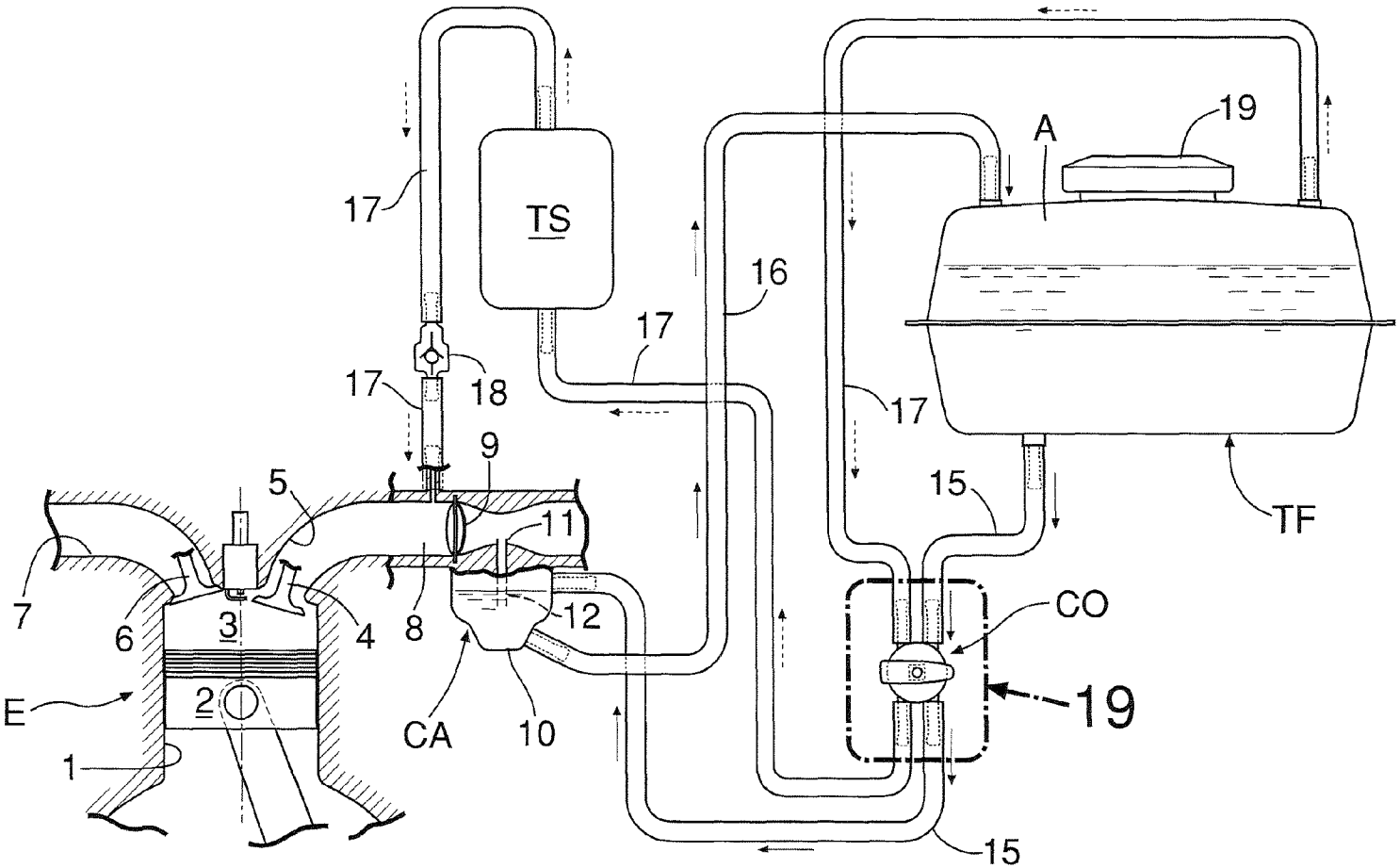
FIG. 18A is an overall schematic diagram of an automatic residual fuel vent device for a carburetor related to an eighth embodiment.
Figure 18B:
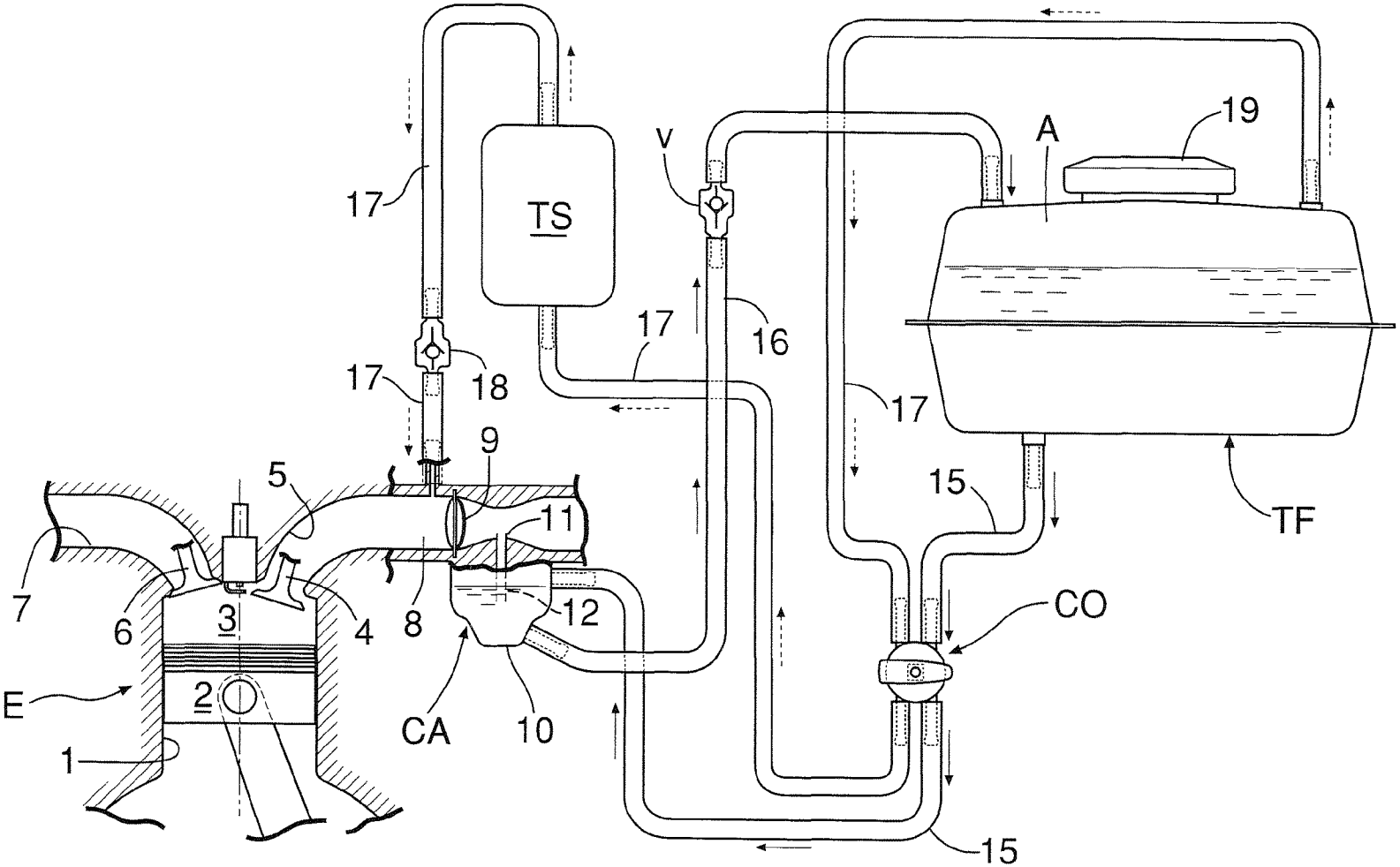
FIG. 18B is an overall schematic diagram of an automatic residual fuel vent device for a carburetor related to a modified example of the eighth embodiment.
Figure 19:
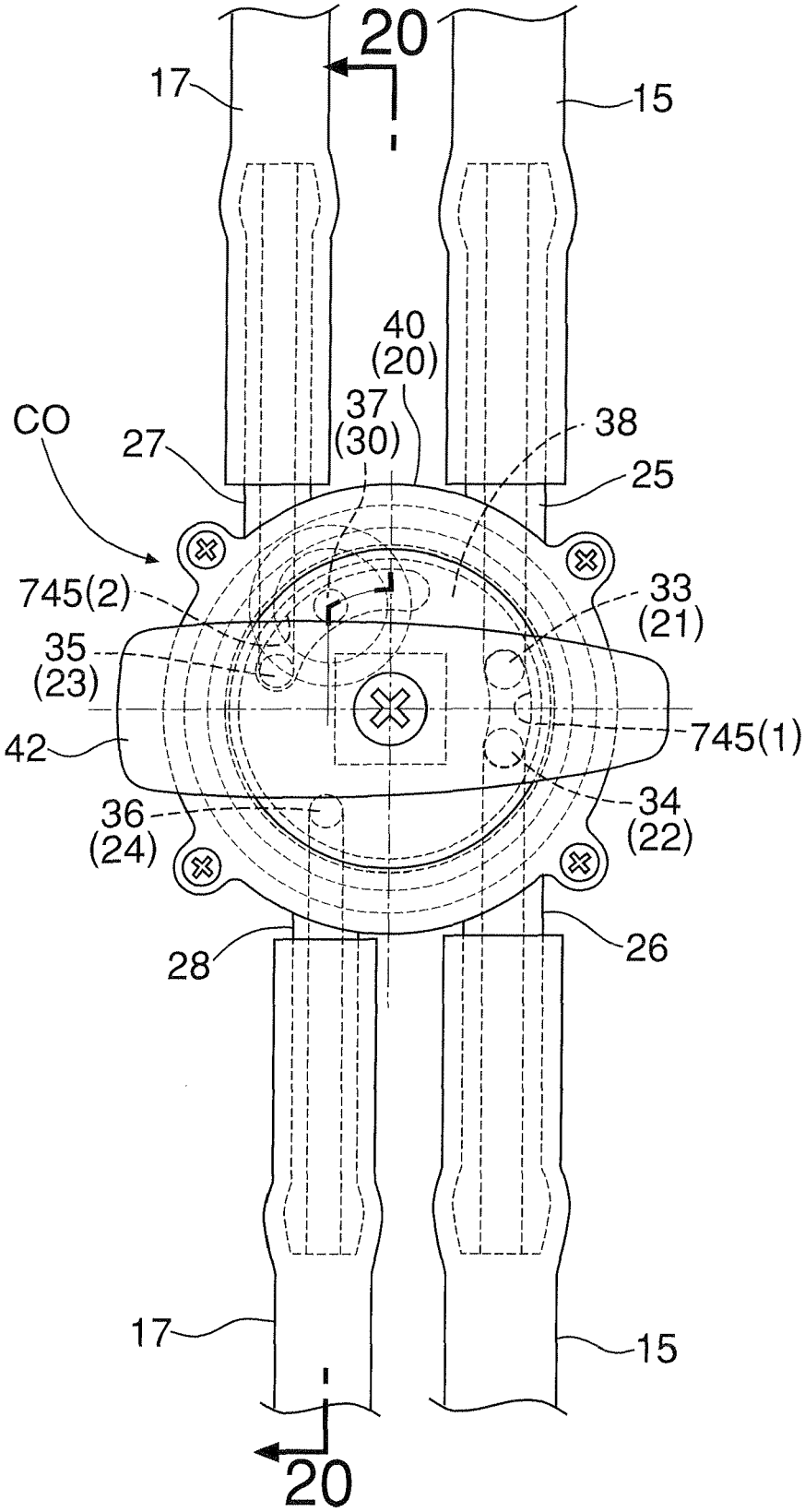
FIG. 19 is an enlarged view of a portion surrounded by a phantom line shown by arrow 19 in FIG. 18A.
Figure 20:
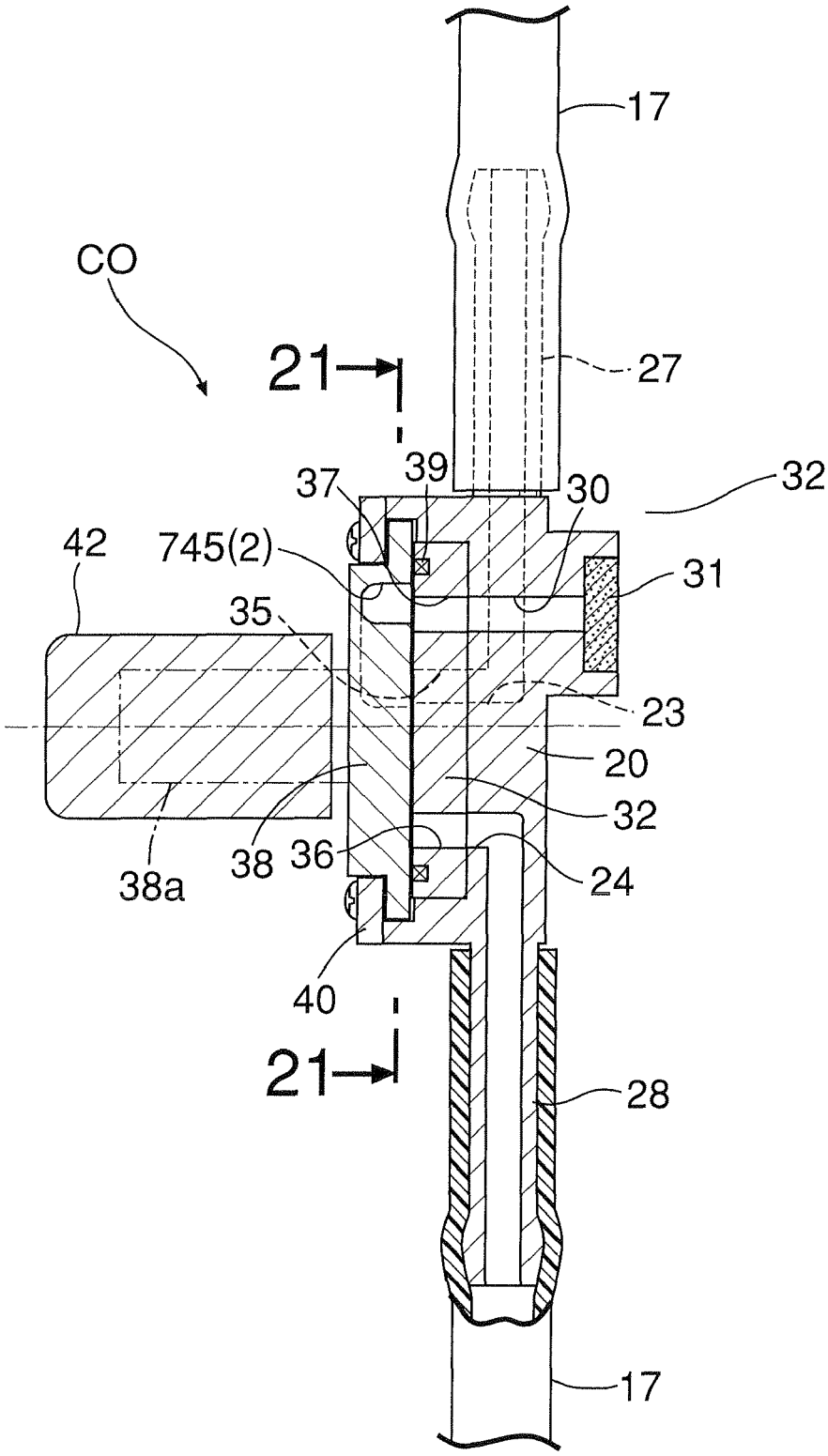
FIG. 20 is a sectional view along line 20-20 in FIG. 19.

FIG. 18B shows a modified example of the eighth embodiment of the present invention.

In FIG. 18B, elements that are the same as those of the eighth embodiment are denoted by the same reference numerals and symbols.

In this modified example, a one-way valve v is disposed partway along a fuel supply passage 16 connecting a hermetically sealed fuel tank TF and a float chamber 10. This one-way valve v prevents the backflow of fuel, flowing through the fuel supply passage 16, from the fuel tank TF to a float chamber 19, and this prevents air within the fuel tank TF from contaminating fuel within the float chamber 10 when the engine E is running.

A ninth embodiment of the present invention is now explained by reference to FIGS. 23 and 24.

Figure 23:
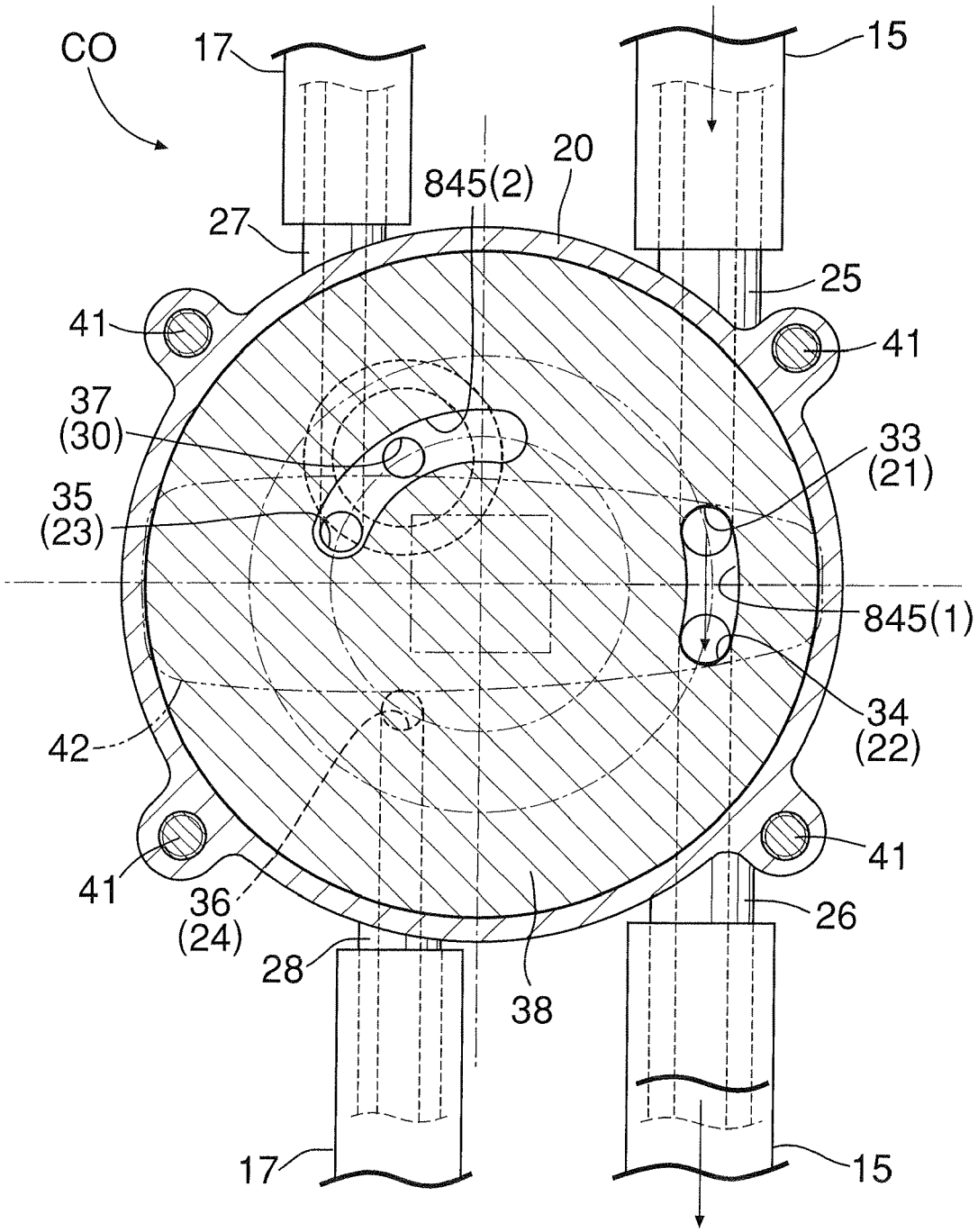
FIG. 23 is a sectional view of a changeover cock related to a ninth embodiment.
Figure 24:
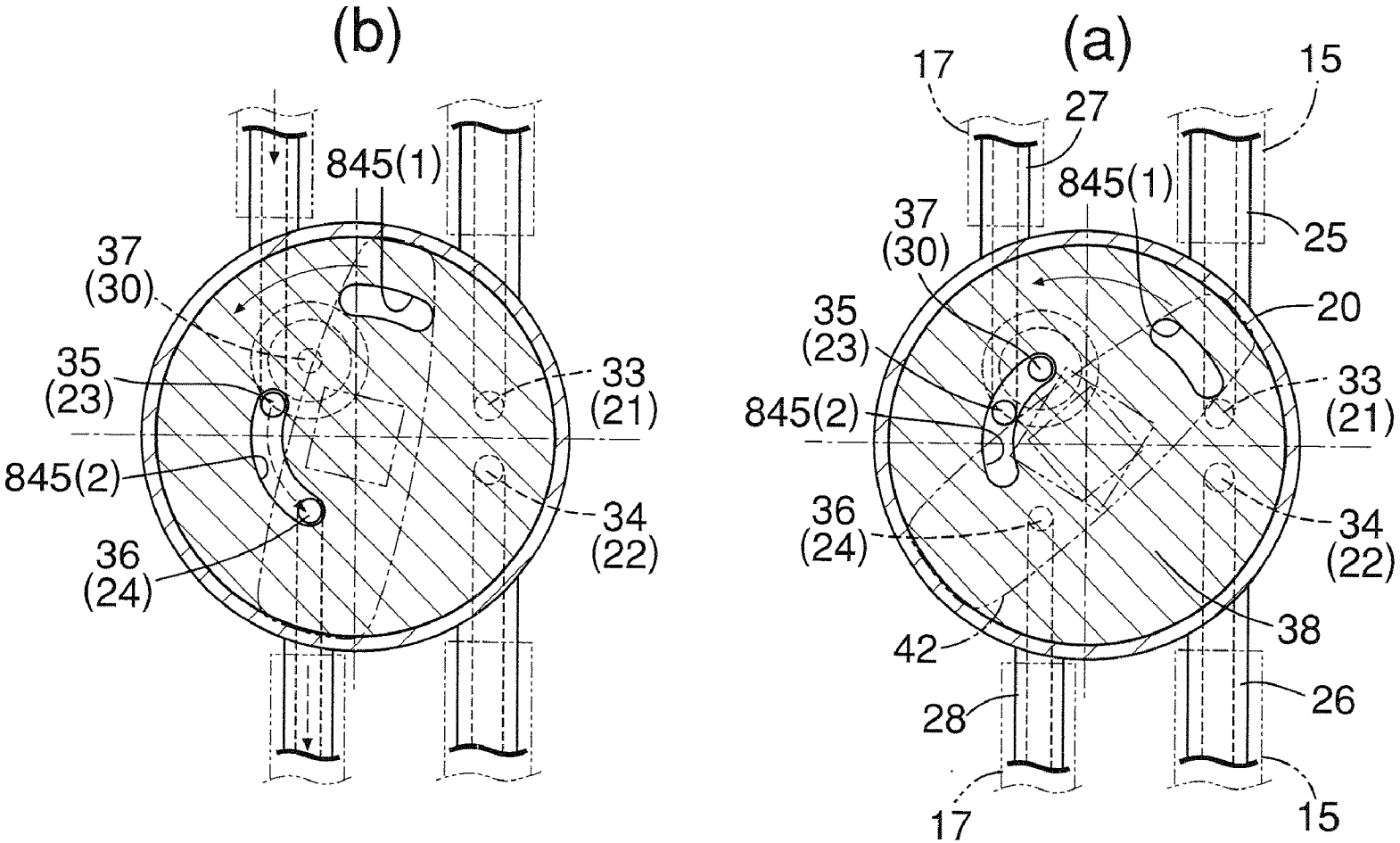
FIG. 24 is a diagram of the operation of the changeover cock of the ninth embodiment.

In FIGS. 23 and 24, elements that are the same as those of the eighth embodiment are denoted by the same reference numerals and symbols.

This ninth embodiment has substantially the same arrangement as that of the eighth embodiment, but the structure of a cock body 38 of a changeover cock CO has some differences from that of the eighth embodiment. That is, arc-shaped first and second communication grooves 845(1) and 845(2) bored in the cock body 38 are disposed on concentric circles with the center of rotation of the cock body 38 as their center so as to be displaced in both the circumferential direction and the radial direction.

When an engine E is used, the cock body 38 of the changeover cock CO is held at an open position shown in FIG. 23, the first communication groove 845(1) of the cock body 38 maintains a first port 21 and a second port 22 in a communicating state, a third port 23 and a fourth port 24 are maintained in a blocked state, and the second communication groove 845(2) provides communication between the third port 23 and an atmosphere communication opening 30. This allows a fuel supply passage 15 to attain a communicating state, fuel within a fuel tank TF is supplied to a float chamber 10 of a carburetor CA, and an air chamber A of the fuel tank TF communicates with the atmosphere. When the engine E is run in this state, intake negative pressure within an intake passage 8 acts on a negative pressure surge tank TS via a negative pressure passage 17, and negative pressure is accumulated in the tank TS.

Subsequently, when running of the engine E is stopped, the cock body 38 of the changeover cock CO is pivoted in an anticlockwise direction from the running position of FIG. 23, and is held at a closed position as shown in FIG. 24 (*a*). This allows the first and second communication grooves 845(1) and 845(2) of the cock body 38 of the cock CO to attain a neutral position, the cock body 38 puts both the first port 21 and second port 22 and the third port 23 and fourth port 24 into a blocked state, the fuel supply passage 15 therefore attains a blocked state, supply of fuel from the fuel tank TF to the float chamber 10 is cut off, and the communicating state of the air chamber A of the fuel tank TF with the atmosphere is maintained.

Subsequently, pivoting the cock body of the changeover cock CO in an anticlockwise direction as shown from FIG. 24(*a*) to (*b*) allows the cock body 38 to block the first port 21 and the second port 22, provide communication between the third port 23 and the fourth port 24 while maintaining the fuel supply passage 15 in a blocked state, put the negative pressure passage 17 into a communicating state, and cut off communication between the air chamber A and the atmosphere; negative pressure already accumulated within the negative pressure surge tank TS therefore acts on the hermetically sealed air chamber A of the fuel tank TF through the negative pressure passage 17, and the air chamber A is put into a high negative pressure state. This enables residual fuel within the float chamber 10 to be drawn up into the air chamber of the fuel tank TF.

A tenth embodiment of the present invention is now explained by reference to FIG. 25.

Figure 25:
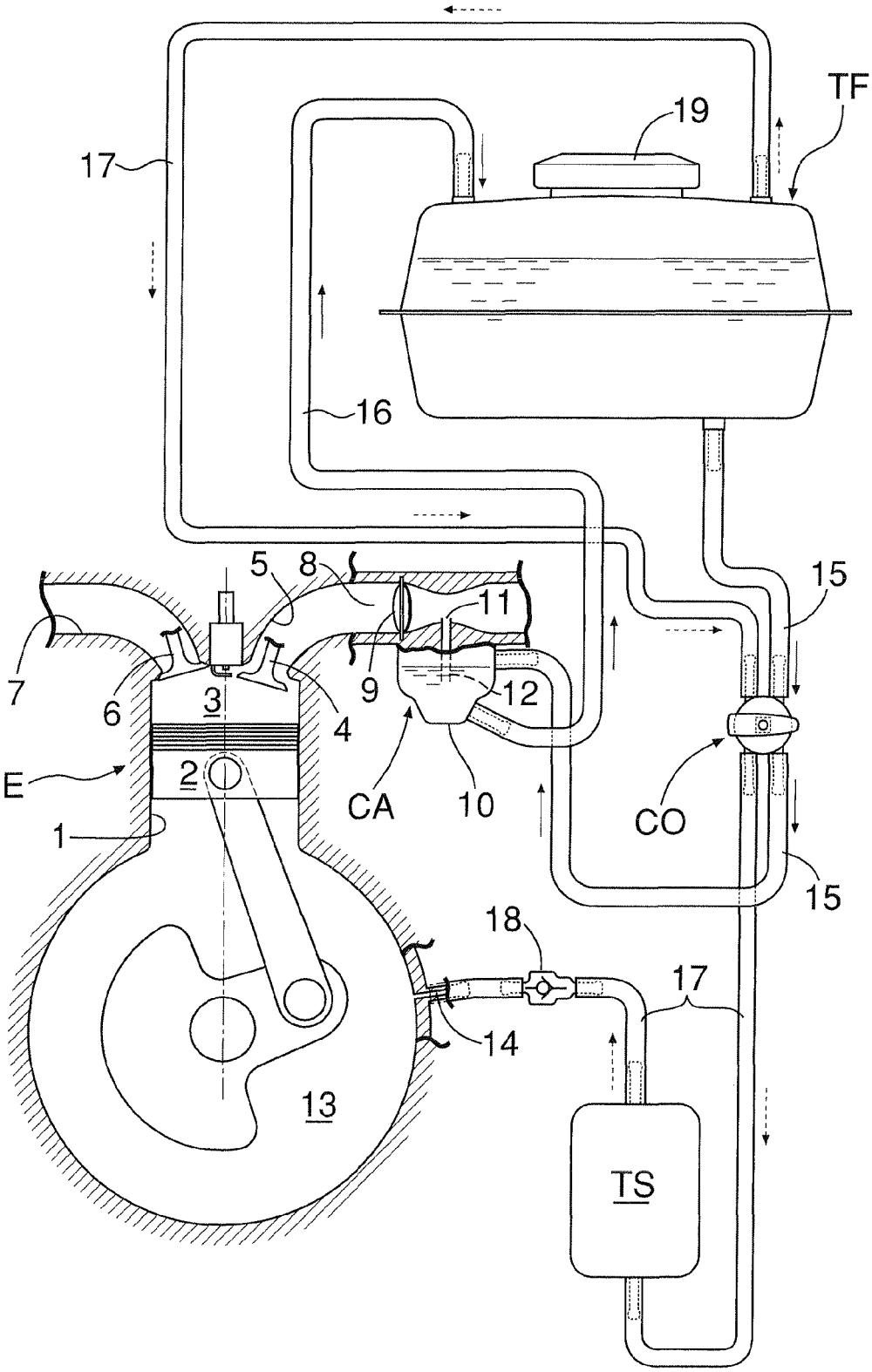
FIG. 25 is an overall schematic diagram of an automatic residual fuel vent device for a carburetor related to a tenth embodiment.

In FIG. 25, elements that are the same as those of the eighth and ninth embodiments are denoted by the same reference numerals and symbols.

In the eighth and ninth embodiments, negative pressure for operating the automatic residual fuel vent device of the carburetor CA is extracted from the intake passage 8 of an intake system of the engine E, but in this tenth embodiment the negative pressure is extracted from a crank chamber 13 of an engine E, the arrangement otherwise being the same as that of the eighth and ninth embodiments. A negative pressure extraction hole 14 is opened in one side of the crank chamber 13, and a negative pressure passage 17 communicating with a negative pressure surge tank TS is connected to the negative pressure extraction hole 14.

Negative pressure within the crank chamber 13 generated by running of the engine E accumulates within the negative pressure surge tank TS via a one-way valve 18, and is used as a power source for automatic venting of residual fuel of the carburetor CA.

The first to tenth embodiments of the present invention are explained above, but the present invention is not limited to these embodiments, and various embodiments are possible within the spirit and scope of the present invention.

For example, in the embodiments above, a case in which the automatic residual fuel vent device for the carburetor is applied to an OHC type four cycle general purpose engine is explained, but it is of course possible to apply this to another engine equipped with a float type carburetor.

The invention claimed is:

1. An automatic residual fuel vent device for a carburetor in an engine equipped with a float type carburetor to which fuel within a breather-equipped fuel tank (TF) is supplied via a changeover cock (CO), the automatic residual fuel vent device comprising:

a fuel supply passage (15) connecting a bottom part of the fuel tank (TF) and a float chamber (10) of a carburetor (CA); a negative pressure passage (17) connecting a negative pressure generating part of an engine (E) and a negative pressure operating chamber (53) of a diaphragm pump (PD); a fuel vent passage (16) connecting a bottom part of the float chamber (10) of the carburetor (CA) and an upper part of the fuel tank (TF); a single changeover cock (CO) provided so as to straddle the fuel supply passage (15) and the negative pressure passage (17) and selectively changing over between providing or blocking communication of the fuel supply passage (15), providing or blocking communication of the negative pressure passage (17), and providing or blocking communication of the negative pressure passage (17) with the atmosphere; a negative pressure surge tank (TS) provided in the negative pressure passage (17) between the negative pressure generating part of the engine (E) and the changeover cock (CO); and the diaphragm pump (PD), which is connected partway along the fuel vent passage (16) and is operated by negative pressure of the negative pressure surge tank (TS);

fuel within the fuel tank (TF) being supplied to the float chamber (10) based on control of changeover of the single changeover cock (CO), and residual fuel of the float chamber (10) being drawn up by the diaphragm pump (PD) operated by negative pressure accumulated within the negative pressure surge tank (TS) and being returned to the fuel tank (TF).

2. An automatic residual fuel vent device for a carburetor in an engine equipped with a float type carburetor to which fuel within a breather-equipped fuel tank (TF) is supplied via a changeover cock (CO), the automatic residual fuel vent device comprising:

a fuel supply passage (15) connecting a bottom part of the fuel tank (TF) and a float chamber (10) of a carburetor (CA); a negative pressure passage (17) connecting a negative pressure generating part of an engine (E) and a negative pressure operating chamber (53) of a diaphragm pump (PD); a fuel vent passage (16) connecting a bottom part of the float chamber (10) of the carburetor (CA) and an upper part of the fuel tank (TF); a single changeover cock (CO) provided so as to straddle the fuel supply passage (15) and the negative pressure passage (17) and selectively changing over between providing or blocking communication of the fuel supply passage (15) and providing or blocking communication of the negative pressure passage (17); a negative pressure surge tank (TS) provided in the negative pressure passage (17) between the negative pressure generating part of the engine (E) and the changeover cock (CO); and the diaphragm pump (PD), which is connected partway along the fuel vent passage (16), is operated by negative pressure of the negative pressure surge tank (TS), and has an atmosphere communication passage (430: 530) provided in the negative pressure operating chamber (53);

fuel within the fuel tank (TF) being supplied to the float chamber (10) based on control of changeover of the single changeover cock (CO), and residual fuel of the float chamber (10) being drawn up by the diaphragm pump (PD) and returned to the fuel tank (TF).

3. An automatic residual fuel vent device for a carburetor in an engine equipped with a float type carburetor to which fuel within a hermetically sealed fuel tank (TF) is supplied via a changeover cock (CO), the automatic residual fuel vent device comprising:

a fuel supply passage (15) connecting a bottom part of the fuel tank (TF) and a float chamber (10) of a carburetor (CA); a negative pressure passage (17) connecting a negative pressure generating part of an engine (E) and a hermetically sealed air chamber (A) of an upper part of the fuel tank (TF); a fuel vent passage (16) connecting a bottom part of the float chamber (10) of the carburetor (CA) and the hermetically sealed air chamber (A) of the upper part of the fuel tank (TF); a single changeover cock (CO) provided so as to straddle the fuel supply passage (15) and the negative pressure passage (17) and selectively changing over between providing or blocking communication of the fuel supply passage (15), providing or blocking communication of the negative pressure passage (17), and providing or blocking communication of the negative pressure passage (17) with the atmosphere; and a negative pressure surge tank (TS) provided in the negative pressure passage (17) between the negative pressure generating part of the engine (E) and the changeover cock (CO);

fuel within the fuel tank (TF) being supplied to the float chamber (10) based on control of changeover of the single changeover cock (CO), and residual fuel of the float chamber (10) being drawn up by negative pressure accumulated within the negative pressure surge tank (TS) and being returned to the fuel tank (TF).

4. The automatic residual fuel vent device for a carburetor according to claim 1, 2, or 3, wherein the negative pressure generating part is an intake passage (8) of an intake system of the engine (E) or a crank chamber (13) of the engine (E).

* * * * *